US011014356B2

(12) United States Patent
Nakagawa et al.

(10) Patent No.: US 11,014,356 B2
(45) Date of Patent: May 25, 2021

(54) LIQUID EJECTION HEAD, LIQUID EJECTION MODULE, AND LIQUID EJECTION APPARATUS

(71) Applicant: CANON KABUSHIKI KAISHA, Tokyo (JP)

(72) Inventors: Yoshiyuki Nakagawa, Kawasaki (JP); Akiko Hammura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/526,024

(22) Filed: Jul. 30, 2019

(65) Prior Publication Data

US 2020/0039218 A1 Feb. 6, 2020

(30) Foreign Application Priority Data

Jul. 31, 2018 (JP) ..... JP2018-143907
Apr. 18, 2019 (JP) ..... JP2019-079682

(51) Int. Cl.
*B41J 2/14* (2006.01)
*B41J 2/175* (2006.01)
*B41J 2/045* (2006.01)

(52) U.S. Cl.
CPC ..... *B41J 2/1404* (2013.01); *B41J 2/04501* (2013.01); *B41J 2/175* (2013.01); *B41J 2202/12* (2013.01)

(58) Field of Classification Search
None
See application file for complete search history.

(56) References Cited

U.S. PATENT DOCUMENTS

| | | | |
|---|---|---|---|
| 6,151,049 | A | 11/2000 | Karita et al. |
| 6,217,157 | B1 | 4/2001 | Yoshihira et al. |
| 6,331,050 | B1 | 12/2001 | Nakata et al. |
| 6,431,688 | B1 | 8/2002 | Shin et al. |
| 6,474,792 | B2 | 11/2002 | Sugiyama et al. |
| 9,931,845 | B2 | 4/2018 | Moriya et al. |
| 10,040,290 | B2 | 8/2018 | Okushima et al. |

(Continued)

FOREIGN PATENT DOCUMENTS

| | | |
|---|---|---|
| CN | 1243065 A | 2/2000 |
| CN | 1338379 A | 3/2002 |

(Continued)

OTHER PUBLICATIONS

U.S. Appl. No. 16/526,285, Yoshiyuki Nakagawa Akiko Hammura, filed Jul. 30, 2019.

(Continued)

*Primary Examiner* — Erica S Lin
(74) *Attorney, Agent, or Firm* — Venable LLP

(57) ABSTRACT

In a case where a direction of ejection of a second liquid is a direction from below to above, the second liquid flows above a first liquid in a pressure chamber. A substrate includes an outflow port located downstream of the pressure chamber in a direction of flow of the first liquid and configured to allow the first liquid to flow out of a liquid flow passage. A wall is located in the liquid flow passage and on a section of the substrate on a side opposite to the pressure chamber across the outflow port, the wall including a portion located higher than a surface of a section of the substrate where the pressure chamber is located on a side opposite to the wall across the outflow port.

20 Claims, 15 Drawing Sheets

(56) References Cited

U.S. PATENT DOCUMENTS

| | | | | |
|---|---|---|---|---|
| 10,300,707 | B2 | 5/2019 | Nakakubo et al. | |
| 10,421,287 | B2 | 9/2019 | Yamazaki et al. | |
| 2001/0015735 | A1 | 8/2001 | Matsumoto | |
| 2002/0012026 | A1 | 1/2002 | Kubota et al. | |
| 2005/0223847 | A1* | 10/2005 | Shiraishi | H01F 1/06 75/348 |
| 2010/0238232 | A1 | 9/2010 | Clarke et al. | |
| 2013/0257994 | A1 | 10/2013 | Panchawagh et al. | |
| 2014/0022313 | A1* | 1/2014 | Gao | B41J 2/1412 347/61 |
| 2018/0370230 | A1 | 12/2018 | Nakagawa et al. | |
| 2019/0001672 | A1 | 1/2019 | Hammura et al. | |
| 2019/0009554 | A1 | 1/2019 | Nakagawa | |
| 2019/0092011 | A1 | 3/2019 | Nakagawa et al. | |

FOREIGN PATENT DOCUMENTS

| | | | |
|---|---|---|---|
| JP | 05-169663 | A | 7/1993 |
| JP | 06-305143 | A | 11/1994 |
| JP | 10-24565 | A | 1/1998 |
| JP | 2007-112099 | A | 5/2007 |
| WO | 2018/193446 | A1 | 10/2018 |

OTHER PUBLICATIONS

U.S. Appl. No. 16/526,054, Yoshiyuki Nakagawa Akiko Hammura, filed Jul. 30, 2019.

U.S. Appl. No. 16/526,312, Yoshiyuki Nakagawa Akiko Hammura, filed Jul. 30, 2019.

Extended European Search Report dated Nov. 28, 2019, in European Patent Application No. 19189008.6.

Office Action dated Jun. 4, 2020, in Indian Patent Application No. 201944030683.

Office Action dated Dec. 24, 2020, in Chinese Patent Application No. 201910694233.9.

* cited by examiner

LIQUID EJECTION HEAD, LIQUID EJECTION MODULE, AND LIQUID EJECTION APPARATUS

BACKGROUND OF THE INVENTION

Field of the Invention

This disclosure is related to a liquid ejection head, a liquid ejection module, and a liquid ejection apparatus.

Description of the Related Art

Japanese Patent Laid-Open No. H06-305143 discloses a configuration to retain a liquid serving as an ejection medium and a liquid serving as a bubbling medium in a state separated from each other with an interface defined in between inside a liquid flow passage that communicates with an ejection port, and to cause the bubbling medium to generate a bubble by using a heat generation element, thus ejecting the ejection medium from the ejection port. A position of the interface that moves along with an ejection operation of the ejection medium is controlled by flows of the ejection medium and the bubbling medium. An outflow port to allow the ejection medium to flow out of the liquid flow passage is offset from an outflow port to allow the bubbling medium to flow out of the liquid flow passage.

SUMMARY OF THE INVENTION

In the first aspect of this disclosure, there is provided a liquid ejection head comprising:

a substrate;

a liquid flow passage formed on the substrate and configured to allow a first liquid and a second liquid to flow inside, the liquid flow passage including a pressure chamber;

a pressure generation element configured to apply pressure to the first liquid in the pressure chamber; and an ejection port configured to eject the second liquid, wherein in a case where a direction of ejection of the second liquid is a direction from bottom to top, the second liquid flows above the first liquid in the pressure chamber, the substrate includes a first outflow port located downstream of the pressure chamber in a direction of flow of the first liquid and configured to allow the first liquid to flow out of the liquid flow passage, and the liquid ejection head includes a wall located in the liquid flow passage and on a section of the substrate on a side opposite to the pressure chamber across the first outflow port, the wall including a portion located higher than a surface of a section of the substrate where the pressure chamber is located on a side opposite to the wall across the first outflow port.

In the second aspect of this disclosure, there is provided a liquid ejection module for constituting a liquid ejection head, wherein the liquid ejection head includes a substrate, a liquid flow passage formed on the substrate and configured to allow a first liquid and a second liquid to flow inside, the liquid flow passage including a pressure chamber, a pressure generation element configured to apply pressure to the first liquid in the pressure chamber, and an ejection port configured to eject the second liquid, wherein in a case where a direction of ejection of the second liquid is a direction from bottom to top, the second liquid flows above the first liquid in the pressure chamber, the substrate includes a first outflow port located downstream of the pressure chamber in a direction of flow of the first liquid and configured to allow the first liquid to flow out of the liquid flow passage, the liquid ejection head includes a wall located in the liquid flow passage and on a section of the substrate on an opposite side of the pressure chamber across the first outflow port, the wall including a portion located higher than a surface of a section of the substrate where the pressure chamber is located across the first outflow port, and the liquid ejection head is formed by arraying the multiple liquid ejection modules.

In the third aspect of this disclosure, there is provided a liquid ejection apparatus comprising a liquid ejection head:

the liquid ejection head including a substrate, a liquid flow passage formed on the substrate and configured to allow a first liquid and a second liquid to flow inside, the liquid flow passage including a pressure chamber, a pressure generation element configured to apply pressure to the first liquid in the pressure chamber, and an ejection port configured to eject the second liquid, wherein in a case where a direction of ejection of the second liquid is a direction from bottom to top, the second liquid flows above the first liquid in the pressure chamber, the substrate includes a first outflow port located downstream of the pressure chamber in a direction of flow of the first liquid and configured to allow the first liquid to flow out of the liquid flow passage, and the liquid ejection head includes a wall located in the liquid flow passage and on a section of the substrate on an opposite side of the pressure chamber across the first outflow port, the wall including a portion located higher than a surface of a section of the substrate where the pressure chamber is located across the first outflow port.

According to an embodiment of this disclosure, the multiple types of liquids flowing into the liquid flow passage can be collected while being appropriately separated from one another.

Further features of the present invention will become apparent from the following description of exemplary embodiments with reference to the attached drawings.

DESCRIPTION OF THE EMBODIMENTS

According to Japanese Patent Laid-Open No. H06-305143, the interface is displaced from a position between the outflow port for the ejection medium and the outflow port for the bubbling medium along with an operation to eject the ejection medium. For this reason, it is difficult to collect the ejection medium and the bubbling medium separately from each other through the respective outflow ports.

Embodiments of this disclosure provide a liquid ejection head, a liquid ejection module, and a liquid ejection apparatus, which are capable of appropriately separating and collecting liquids that flow into a liquid flow passage.

Now, embodiments of this disclosure will be described with reference to the drawings.

First Embodiment (Configuration of Liquid Ejection Head)

Figure 1:
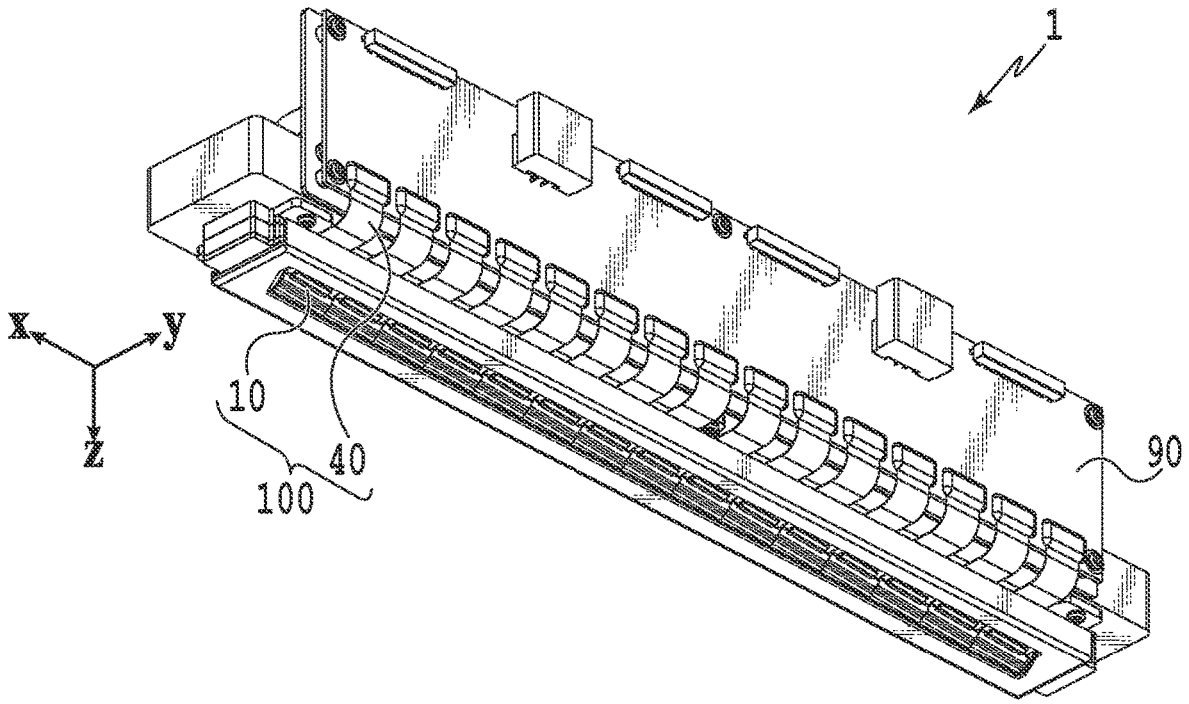
FIG. 1 is a perspective view of an ejection head of a first embodiment.

FIG. 1 is a perspective view of a liquid ejection head 1 in this embodiment. The liquid ejection head 1 of this embodiment is formed by arranging multiple liquid ejection modules 100 (an array of modules) in an x direction. Each liquid ejection module 100 includes an element board 10 on which ejection elements are arranged, and a flexible wiring board 40 for supplying electric power and ejection signals to the respective ejection elements. The flexible wiring boards 40 are connected to an electric wiring board 90 used in common, which is provided with arrays of power supply terminals and ejection signal input terminals. Each liquid ejection module 100 is easily attachable to and detachable from the liquid ejection head 1. Accordingly, any desired liquid ejection module 100 can be easily attached from outside to or detached from the liquid ejection head 1 without having to disassemble the liquid ejection head 1.

Given the liquid ejection head 1 formed by the multiple arrangement of the liquid ejection modules 100 (by arranging multiple modules) in a longitudinal direction as described above, even if a certain one of the ejection elements causes an ejection failure, only the liquid ejection module involved in the ejection failure needs to be replaced. Thus, it is possible to improve a yield of the liquid ejection heads 1 during a manufacturing process thereof, and to reduce costs for replacing the head.

(Configuration of Liquid Ejection Apparatus)

Figure 2:
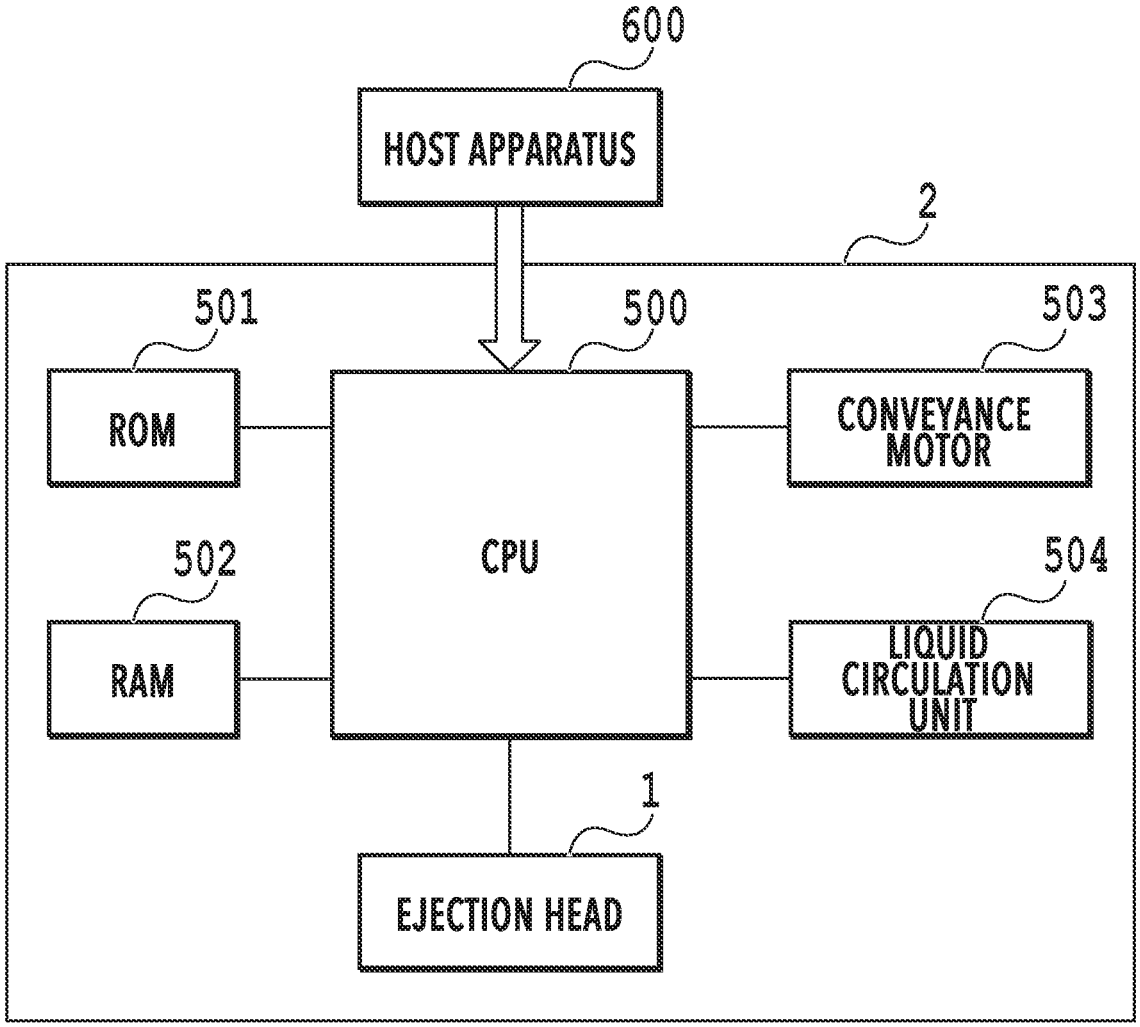
FIG. 2 is a block diagram of a control system of a liquid ejection apparatus of the first embodiment.

FIG. 2 is a block diagram showing a control configuration of a liquid ejection apparatus 2 usable in the embodiment of the present disclosure. A CPU 500 controls the entire liquid ejection apparatus 2 in accordance with programs stored in a ROM 501 while using a RAM 502 as a work area. The CPU 500 performs prescribed data processing in accordance with the programs and parameters stored in the ROM 501 on ejection data to be received from an externally connected host apparatus 600, for example, thereby generating the ejection signals for causing the liquid ejection head 1 to eject liquid. Then, the liquid ejection head 1 is driven in accordance with the ejection signals while a target medium for depositing the liquid is moved in a predetermined direction by driving a conveyance motor 503. Thus, the liquid ejected from the liquid ejection head 1 is deposited on the deposition target medium for adhesion. In the case where the liquid ejection apparatus 2 constitutes an inkjet printing apparatus, the liquid ejection head 1 serving as an inkjet printing head ejects inks while the conveyance motor 503 conveys a printing medium in order to move the liquid ejection head 1 relative to the printing medium.

A liquid circulation unit 504 is a unit configured to circulate and supply the liquid to the liquid ejection head 1 and to conduct flow control of the liquid in the liquid ejection head 1. The liquid circulation unit 504 includes a sub-tank to store the liquid, a flow passage for circulating the liquid between the sub-tank and the liquid ejection head 1, pumps, a flow rate control unit for controlling a flow rate of the liquid flowing in the liquid ejection head 1, and so forth. Hence, under the instruction of the CPU 500, the liquid circulation unit 504 controls these mechanisms such that the liquid flows in the liquid ejection head 1 at a predetermined flow rate.

(Configuration of Element Board)

Figure 3:
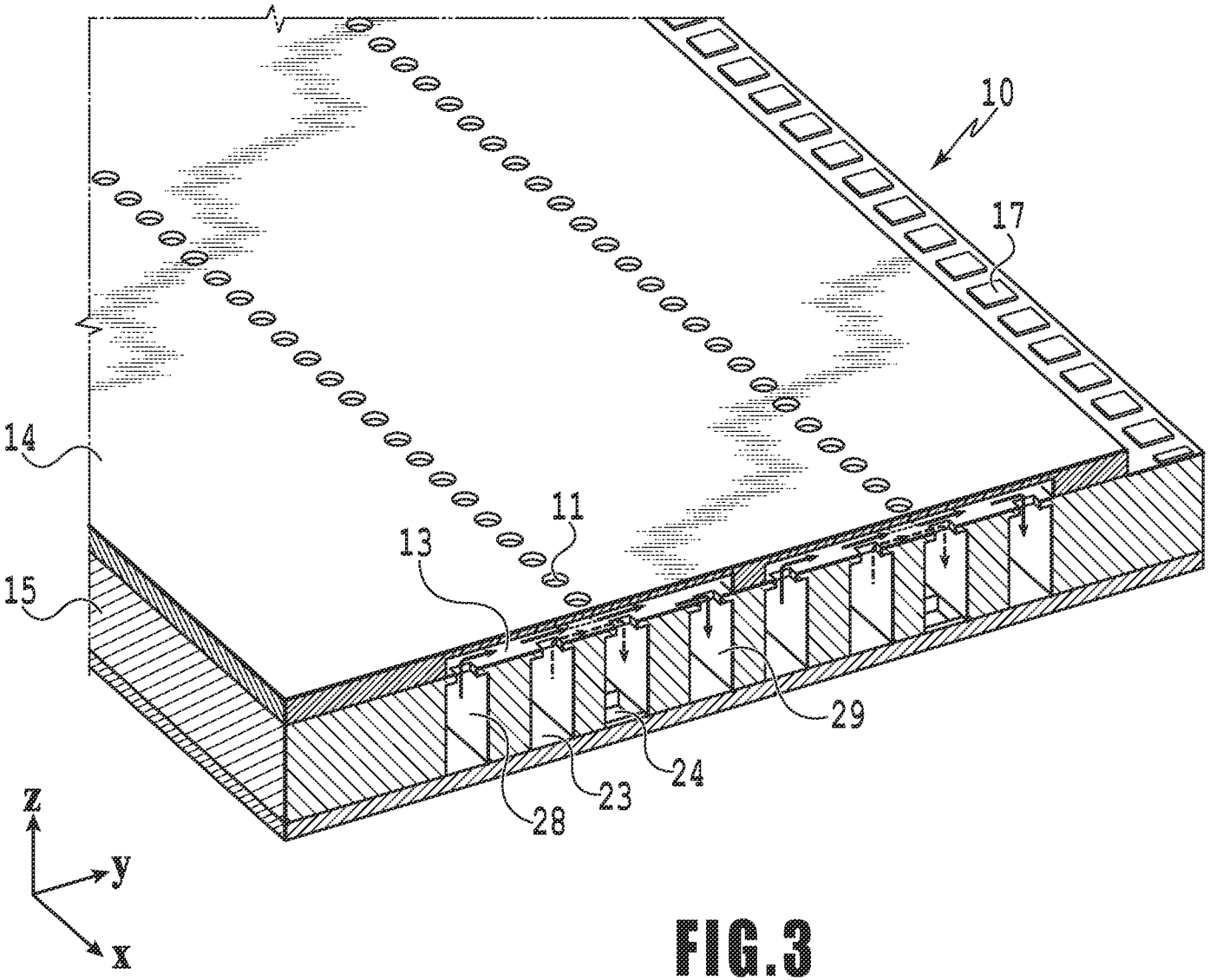
FIG. 3 is a cross-sectional perspective view of a liquid ejection module in FIG. 1.

FIG. 3 is a cross-sectional perspective view of the element board 10 provided in each liquid ejection module 100. The element board 10 is formed by stacking an orifice plate 14 (ejection port forming member) on a silicon (Si) substrate 15. In the orifice plate 14, arrays of multiple ejection ports 11 for ejecting liquid are formed in the x direction. In FIG. 3, ejection ports 11 arranged in the x direction eject the liquid of the same type (such as a liquid supplied from a common sub-tank and a common supply port). FIG. 3 illustrates an example in which the orifice plate 14 is also provided with liquid flow passages 13. Instead, the element board 10 may adopt a configuration in which the liquid flow passages 13 are formed by using a different component (a flow passage forming member) and the orifice plate 14 provided with the ejection ports 11 is placed thereon.

Pressure generation elements 12 (not shown in FIG. 3) are disposed, on the silicon substrate 15, at positions corresponding to the respective ejection ports 11. Each ejection port 11 and the corresponding pressure generation element 12 are located at such positions that are opposed to each other. In a case where a voltage is applied to the pressure generation element 12 in response to an ejection signal, the pressure generation element 12 applies a pressure to the liquid in a z direction orthogonal to a flow direction (a y direction) of the liquid. Accordingly, the liquid is ejected in the form of a droplet from the ejection port 11 opposed to the pressure generation element 12. The flexible wiring board 40 (see FIG. 1) supplies the electric power and driving signals to the pressure generation elements 12 via terminals 17 arranged on the silicon substrate 15. Although a silicon substrate is used as the substrate 15 in this case, the substrate may be formed from a different member. Meanwhile, if the substrate 15 is made of the silicon substrate, then an oxide film (layer), an insulating film (layer), and the like provided to the silicon substrate will be collectively referred to as the substrate (the silicon substrate).

The multiple liquid flow passages 13 which extend in the y direction and are connected respectively to the ejection ports 11 are formed between the silicon substrate 15 and the orifice plate 14 on the substrate (the silicon substrate 15). In each of the liquid flow passages 13, liquids including a first liquid and a second liquid (to be described later) flow. The liquid flow passages 13 arranged in the x direction are connected to a first common supply flow passage 23, a first common collection flow passage 24, a second common supply flow passage 28, and a second common collection flow passage 29 in common. Flows of liquids in the first common supply flow passage 23, the first common collection flow passage 24, the second common supply flow passage 28, and the second common collection flow passage 29 are controlled by the liquid circulation unit 504 in FIG. 2. To be more precise, the pump is controlled such that the first liquid flowing from the first common supply flow passage 23 into the liquid flow passages 13 is directed to the first common collection flow passage 24 while the second liquid flowing from the second common supply flow passage 28 into the liquid flow passages 13 is directed to the second common collection flow passage 29.

FIG. 3 illustrates an example in which the ejection ports 11 and the liquid flow passages 13 arranged in the x direction, and the first and second common supply flow passages 23 and 28 as well as the first and second common collection flow passages 24 and 29 used in common for supplying and collecting inks to and from these ports and passages are defined as a set, and two sets of these constituents are arranged in the y direction.

(Configurations of Flow Passage and Pressure Chamber)

Figure 4A:
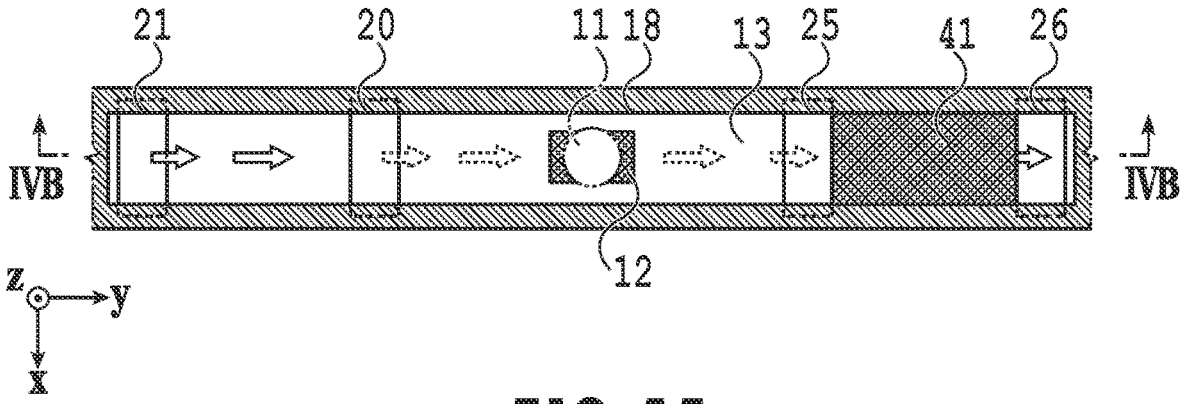
FIG. 4A is a transparent view of a liquid flow passage in an element board in FIG. 1.
Figure 4B:
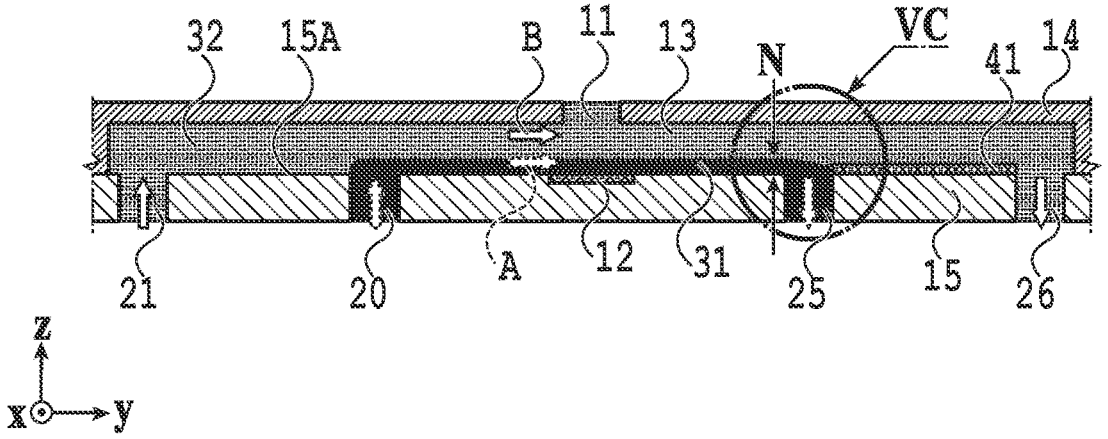
FIG. 4B is a cross-sectional view taken along the IVB-IVB line in FIG. 4A.
Figure 5A:
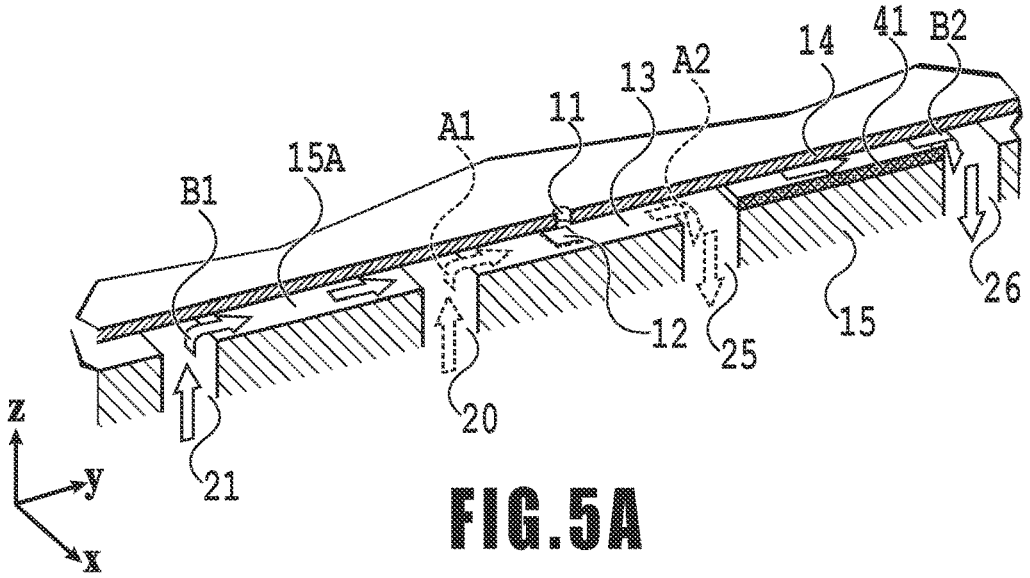
FIG. 5A is a perspective view of the liquid flow passage in FIG. 4A.
Figure 5B:
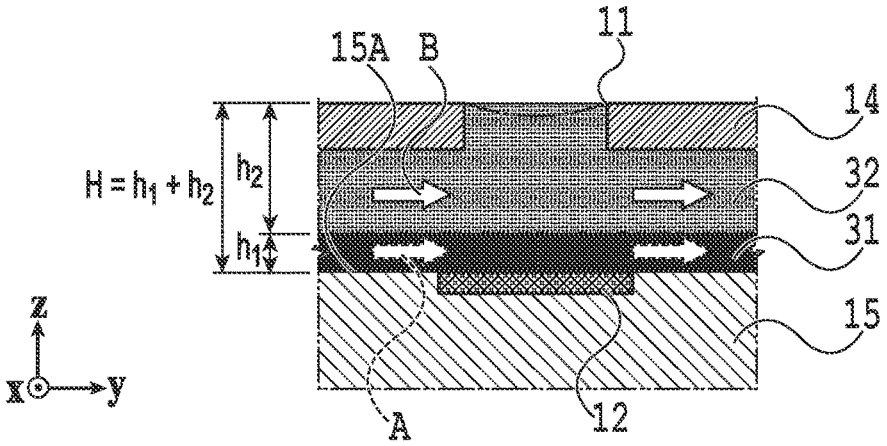
FIG. 5B is an enlarged diagram of a portion near an ejection port in FIG. 4B.
Figure 5C:
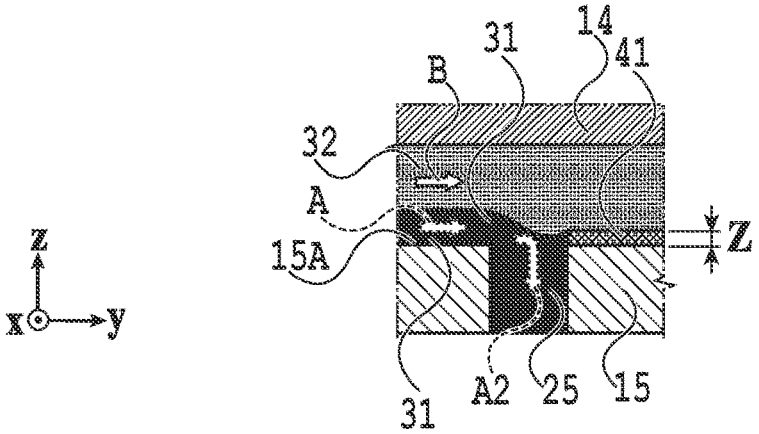
FIG. 5C is an enlarged diagram of a portion VC in FIG. 4B.

FIGS. 4A to 5C are diagrams for explaining detailed configurations of each liquid flow passage 13 and of each pressure chamber 18 formed in the element board 10. FIG. 4A is a perspective view from the ejection port 11 side (from a +z direction side), and FIG. 4B is a cross-sectional view taken along the IVB-IVB line shown in FIG. 4A. Meanwhile, FIG. 5A is a perspective view of the liquid flow passage 13 in FIG. 4A, FIG. 5B is an enlarged diagram of the neighborhood of the ejection port 11 in FIG. 4B, and FIG. 5C is an enlarged diagram of the neighborhood of a first outflow port 25 in FIG. 4B (a portion VC in FIG. 4B).

The silicon substrate 15 corresponding to a bottom portion (wall portion) of the liquid flow passage 13 includes a second inflow port 21, a first inflow port 20, the first outflow port 25, and a second outflow port 26, which communicate with the liquid flow passage 13 and are formed in this order in the y direction. Moreover, the pressure chamber 18 including the ejection port 11 and the pressure generation element 12 is located substantially at the center between the first inflow port 20 and the first outflow port 25 in the liquid flow passage 13. The second inflow port 21 is connected to the second common supply flow passage 28, the first inflow port 20 is connected to the first common supply flow passage 23, the first outflow port 25 is connected to the first common collection flow passage 24, and the second outflow port 26 is connected to the second common collection flow passage 29 (see FIG. 3).

The first inflow port 20 causes the first liquid 31 to flow from an upstream side in a direction of flow of the liquid in the liquid flow passage 13 into the liquid flow passage 13. The first liquid 31 supplied from the first common supply flow passage 23 through the first inflow port 20 flows into the liquid flow passage 13 as indicated with an arrow A1 and then flows inside the liquid flow passage 13 in the direction of arrows A. Thereafter, the first liquid 31 passes through the pressure chamber 18 and flows out of the first outflow port 25 as indicated with an arrow A2. Then, the first liquid 31 is collected by the first common collection flow passage 24 (see FIG. 5A). The second inflow port 21 is located upstream of the first inflow port 20 in the direction of flow of the liquid in the liquid flow passage 13. The second liquid 32 supplied from the second common supply flow passage 28 through the second inflow port 21 flows into the liquid flow passage 13 as indicated with an arrow B1 and then flows inside the liquid flow passage 13 in the direction of arrows B. Thereafter, the second liquid 32 passes through the pressure chamber 18 and flows out of the second outflow port 26 as indicated with an arrow B2. Then, the second liquid 32 is collected by the second common collection flow passage 29 (see FIG. 5A). Both of the first liquid 31 and the second liquid 32 flow in the y direction in a section of the liquid flow passage 13 between the first inflow port 20 and the first outflow port 25. In this instance, inside the pressure chamber 18, the first liquid 31 comes into contact with an inner surface of the pressure chamber 18 (a bottom surface on a lower side in FIG. 5B) where the pressure generation element 12 is located. Meanwhile, the second liquid 32 forms a meniscus at the ejection port 11.

The first liquid 31 and the second liquid 32 flow in the pressure chamber 18 such that the pressure generation element 12, the first liquid 31, the second liquid 32, and the ejection port 11 are arranged in this order. Specifically, assuming that the pressure generation element 12 is located on a lower side and the ejection port 11 is located on an upper side, the second liquid 32 flows above the first liquid 31 and these liquids are in contact with each other. The first liquid 31 and the second liquid 32 flow in a laminar state. Moreover, the first liquid 31 is pressurized by the pressure generation element 12 located below and at least the second liquid 32 is ejected upward from the bottom. Note that this up-down direction corresponds to a height direction of the pressure chamber 18 and of the liquid flow passage 13.

Although the first liquid 31 and the second liquid 32 are not limited to particular liquids, any of water and an ink prepared by causing water to contain a coloring material such as a dye and a pigment can be used as the first liquid 31, for example. Meanwhile, any of an ultraviolet curable ink, an electrically conductive ink, an electron-beam (EB) curable ink, a magnetic ink, a solid ink, and the like can be used as the second liquid 32, for example.

In this embodiment, a flow rate of the first liquid 31 and a flow rate of the second liquid 32 are adjusted in accordance with physical properties of the first liquid 31 and the second liquid 32 such that the first liquid 31 and the second liquid 32 flow along the liquid flow passage while being in contact with each other in the pressure chamber as shown in FIG. 5B. Although the first and second liquids in the first embodiment and a second embodiment (to be described later) and first, second and third liquids in a third embodiment (to be described later) form parallel flows flowing in the same direction, the embodiments are not limited to this mode. Specifically, in the first embodiment, the second liquid may flow in a direction opposite to the direction of flow of the first liquid. Alternatively, flow passages may be provided such that the flow of the first liquid crosses the flow of the second liquid. Moreover, although the liquid ejection head is configured such that the second liquid flows above the first liquid in the height direction of the liquid flow passage (pressure chamber), the liquid ejection head is not limited to this configuration. The same applies in the second and third embodiment (to be described later). In the following, the parallel flows among these modes will be described as an example.

In the case of the parallel flows, it is preferable to keep an interface between the first liquid 31 and the second liquid 32 from being disturbed, or in other words, to establish a state of laminar flows inside the pressure chamber 18 with the flows of the first liquid 31 and the second liquid 32. Specifically, in the case of an attempt to control an ejection performance so as to maintain a predetermined amount of ejection, it is preferable to drive the pressure generation element in a state where the interface is stable. Nevertheless, this embodiment is not limited only to this configuration. Even if the flow inside the pressure chamber 18 would transition to a state of turbulence whereby the interface between the two liquids would be somewhat disturbed, the pressure generation element 12 may still be driven in the case where it is possible to maintain the state where at least the first liquid flows mainly on the pressure generation element 12 side and the second liquid flows mainly on the ejection port 11 side. The following description will be mainly focused on the example where the flow inside the pressure chamber is in the state of parallel flows and in the state of laminar flows.

(Conditions to Form Parallel Flows in Concurrence with Laminar Flows)

Conditions to form laminar flows of liquids in a tube will be described to begin with. The Reynolds number Re to represent a ratio between viscous force and interfacial force has been generally known as a flow evaluation index.

Now, a density of a liquid is defined as ρ p, a flow velocity thereof is defined as u, a representative length thereof is defined as d, and a viscosity is defined as η. In this case, the Reynolds number Re can be expressed by the following (formula 1):

$$Re=\rho ud/\eta \qquad \text{(formula 1).}$$

Here, it is known that the laminar flows are more likely to be formed as the Reynolds number Re becomes smaller. To be more precise, it is known that flows inside a circular tube are formed into laminar flows in the case where the Reynolds number Re is smaller than about 2200 and the flows inside the circular tube become turbulent flows in the case where the Reynolds number Re is larger than about 2200.

In the case where the flows are formed into the laminar flows, flow lines become parallel to a traveling direction of the flows without crossing each other. Accordingly, in the case where the two liquids in contact constitute the laminar flows, the liquids can form the parallel flows with the stable interface between the two liquids. Here, in view of a general inkjet printing head, a height H [μm] of the flow passage (the height of the pressure chamber) in the vicinity of the ejection port in the liquid flow passage (the pressure chamber) is in a range from about 10 to 100 μm. In this regard, in the case where water (density p=1.0×103 kg/m$^3$, viscosity η=1.0 cP) is fed to the liquid flow passage of the inkjet printing head at a flow velocity of 100 mm/s, the Reynolds number Re turns out to be Re=ρud/η≈0.1~1.0<<2200. As a consequence, the laminar flows can be deemed to be formed therein.

Here, even if the liquid flow passage 13 and the pressure chamber 18 of this embodiment have rectangular cross-sections as shown in FIG. 4A, the heights and widths of the liquid flow passage 13 and the pressure chamber 18 in the liquid ejection head are sufficiently small. For this reason, the liquid flow passage 13 and the pressure chamber 18 can be treated like in the case of the circular tube, or more specifically, the heights of the liquid flow passage 13 and the pressure chamber 18 can be treated as the diameter of the circular tube.

(Theoretical Conditions to Form Parallel Flows in State of Laminar Flows)

Next, conditions to form the parallel flows with the stable interface between the two types of liquids in the liquid flow passage 13 and the pressure chamber 18 will be described with reference to FIG. 5B. First, a distance from the silicon substrate 15 to an opening surface (ejection port surface) of the ejection port 11 of the orifice plate 14, that is, a height of the pressure chamber 18 is defined as H [μm]. Then a distance between the ejection port surface and an interface (liquid-liquid interface) between the first liquid 31 and the second liquid 32 (a phase thickness of the second liquid) is defined as $h_2$ [μm]. In addition, a distance between the interface and the silicon substrate 15 (a phase thickness of the first liquid) is defined as $h_1$ [μm]. These definitions bring about $H=h_1+h_2$.

As for boundary conditions in the liquid flow passage 13 and the pressure chamber 18, velocities of the liquids on wall surfaces of the liquid flow passage 13 and the pressure chamber 18 are assumed to be zero. Moreover, velocities and shear stresses of the first liquid 31 and the second liquid 32 at the interface are assumed to have continuity. Based on the assumption, if the first liquid 31 and the second liquid 32 form two-layered and parallel steady flows, then a quartic equation as defined in the following (formula 2) holds true in a section of the parallel flows:

$$\begin{aligned}&(\eta_1-\eta_2)(\eta_1Q_1+\eta_2Q_2)h_1^4+2\eta_1H\{\eta_2(3Q_1+Q_2)-\\&\quad 2\eta_1Q_1\}h_1^3+3\eta_1H^2\{2\eta_1Q_1-\eta_2(3Q_1+Q_2)\}h_1^2+\\&\quad 4\eta_1Q_1H^3(\eta_2-\eta_1)h_1+\eta_1^2Q_1H^4=0 \qquad \text{(formula 2).}\end{aligned}$$

In the (formula 2), $\eta_1$ represents the viscosity of the first liquid 31, $\eta_2$ represents the viscosity of the second liquid 32, $Q_1$ represents the flow rate (volume flow rate [um$^3$/us]) of the first liquid 31, and $Q_2$ represents the flow rate (volume flow rate [um$^3$/us]) of the second liquid 32. In other words, the first liquid and the second liquid flow so as to establish a positional relationship in accordance with the flow rates and the viscosities of the respective liquids within such ranges to satisfy the above-mentioned quartic equation (formula 2), thereby forming the parallel flows with the stable interface. In this embodiment, it is preferable to form the parallel flows of the first liquid and the second liquid in the liquid flow passage 13 or at least in the pressure chamber 18. In the case where the parallel flows are formed as mentioned above, the first liquid and the second liquid are only involved in mixture due to molecular diffusion on the liquid-liquid interface therebetween, and the liquids flow in parallel in the y direction virtually without causing any mixture. Note that the flows of the liquids do not always have to establish the state of laminar flows in a certain region in the pressure chamber 18. In this context, it is preferable that at least the flows of the liquids in a region above the pressure generation element establish the state of laminar flows.

Even in the case of using immiscible solvents such as oil and water as the first liquid and the second liquid, for example, the stable parallel flows are formed regardless of the immiscibility as long as the (formula 2) is satisfied. Meanwhile, even in the case of oil and water, if the interface is disturbed due to a state of slight turbulence of the flow in the pressure chamber, it is preferable that at least the first liquid flows mainly on the pressure generation element and the second liquid flows mainly in the ejection port.

Figure 6A:
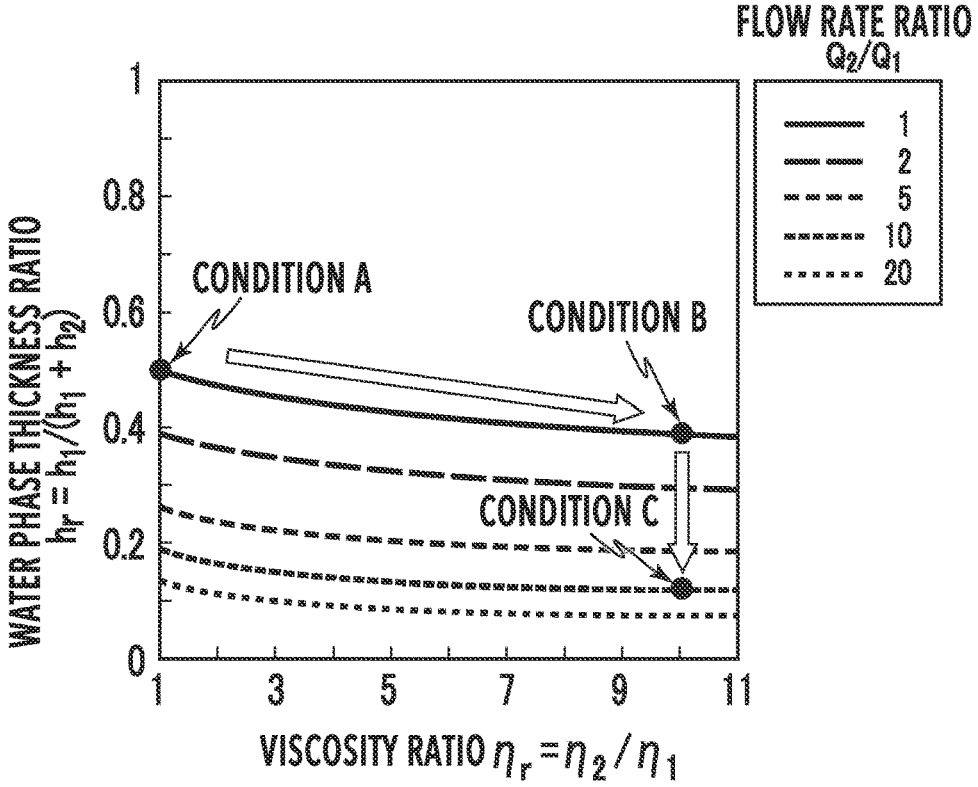
FIG. 6A is an explanatory diagram of relations between a viscosity ratio and a water phase thickness ratio of liquids.

FIG. 6A is a graph representing a relation between a viscosity ratio $\eta_r=\eta_2/\eta_1$ and a phase thickness ratio $h_r=h_1/(h_1+h_2)$ of the first liquid while changing a flow rate ratio $Q_r=Q_2/Q_1$ to several levels in (formula 2). Although the first liquid is not limited to water, the "phase thickness ratio of the first liquid" will be hereinafter referred to as a "water phase thickness ratio". The horizontal axis indicates the viscosity ratio $\eta_r=\eta_2/\eta_1$ and the vertical axis indicates the water phase thickness ratio $h_r=h_1/(h_1+h_2)$. The water phase thickness ratio $h_r$ becomes lower as the flow rate ratio $Q_r$ grows higher. Meanwhile, at each level of the flow rate ratio $Q_r$, the water phase thickness ratio $h_r$ becomes lower as the viscosity ratio $\eta_r$ grows higher. Therefore, the water phase thickness ratio $h_r$ (corresponding to the position of the interface between the first liquid and the second liquid) in the liquid flow passage 13 (the pressure chamber) can be adjusted to a prescribed value by controlling the viscosity ratio $\eta_r$ and the flow rate ratio $Q_r$ between the first liquid and the second liquid. In addition, in the case where the viscosity ratio $\eta_r$ is compared with the flow rate ratio $Q_r$, FIG. 6A teaches that the flow rate ratio $Q_r$ has a larger impact on the water phase thickness ratio $h_r$ than the viscosity ratio $\eta_r$ does.

Note that condition A, condition B, and condition C in FIG. 6A represent the following conditions:

Condition A: the viscosity ratio $\eta_r=1$, the flow rate ratio $Q_r=1$, and the water phase thickness ratio hr=0.50;

Condition B: the viscosity ratio $\eta_r=10$, the flow rate ratio $Q_r=1$, and the water phase thickness ratio hr=0.39; and Condition C: the viscosity ratio $\eta_r=10$, the flow rate ratio $Q_r=10$, and the water phase thickness ratio hr=0.12.

Figure 6B:
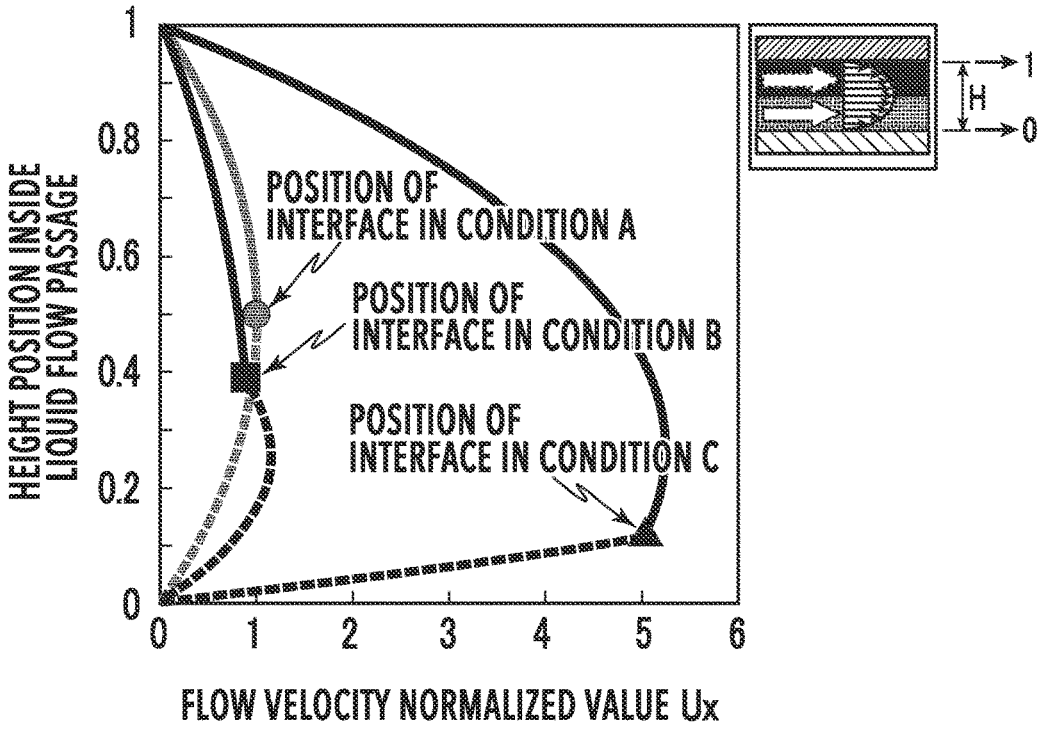
FIG. 6B is an explanatory diagram of relations between a height of a pressure chamber and a flow velocity.

FIG. 6B is a graph showing flow velocity distribution in the height direction (the z direction) of the liquid flow passage 13 (the pressure chamber) regarding the above-mentioned conditions A, B, and C. The horizontal axis indicates a normalized value Ux which is normalized by defining the maximum flow velocity value in the condition A as 1 (a criterion). The vertical axis indicates the height from a bottom surface in the case where the height H [μm] of the liquid flow passage 13 (the pressure chamber) is defined as 1 (a criterion). On each of curves indicating the respective conditions, the position of the interface between the first liquid and the second liquid is indicated with a marker. FIG. 6B shows that the position of the interface varies depending on the conditions such as the position of the interface in the condition A being located higher than the positions of the interface in the condition B and the condition C. The reason for this is that, in the case where the two types of liquids having different viscosities from each other flow in parallel in the tube while forming the laminar flows, the interface between those two liquids is formed at a position where a difference in pressure attributed to the difference in viscosity between the liquid balances a Laplace pressure attributed to interfacial tension.

(Flows of Liquids During Ejection Operation)

As the first liquid and the second liquid flow severally, a liquid level (the liquid-liquid interface) is formed at a position corresponding to the viscosity ratio $\eta_r$ and the flow rate ratio $Q_r$ therebetween (corresponding to the water phase thickness ratio $h_r$). If the liquids are successfully ejected from the ejection port 11 while maintaining the position of the interface, then it is possible to achieve a stable ejection operation. The following are two possible configurations for achieving the stable ejection operation:

Configuration 1: a configuration to eject the liquids in a state where the first liquid and the second liquid are flowing; and Configuration 2: a configuration to eject the liquids in a state where the first liquid and the second liquid are at rest.

The condition 1 makes it possible to eject the liquids stably while retaining the given position of the interface. This is due to a reason that an ejection velocity (several meters per second to greater than ten meters per second) of a droplet in general is faster than flow velocities (several millimeters per second to several meters per second) of the first liquid and the second liquid, and the ejection of the liquids is affected little even if the first liquid and the second liquid are kept flowing during the ejection operation.

In the meantime, the condition 2 also makes it possible to eject the liquids stably while retaining the given position of the interface. This is due to a reason that the first liquid and the second liquid are not mixed immediately due to a diffusion effect on the liquids on the interface, and an unmixed state of the liquids is maintained for a very short period of time. Accordingly, at the point immediately before ejection of the liquids, the interface is maintained in the state where the flows of the liquids are stopped to remain at rest, so that the liquids can be ejected while retaining the position of the interface. However, the configuration 1 is preferable because this configuration can reduce adverse effects of mixture of the first and second liquids due to the diffusion of the liquids on the interface and it is not necessary to conduct advanced control for flowing and stopping the liquids.

(Ejection Modes of Liquids)

A proportion of the first liquid contained in droplets ejected from the ejection port (ejected droplets) can be changed by adjusting the position of the interface (corresponding to the water phase thickness ratio $h_r$). Such ejection modes of the liquids can be broadly categorized into two modes depending on types of the ejected droplets:

Mode 1: a mode of ejecting only the second liquid; and

Mode 2; a mode of ejecting the second liquid inclusive of the first liquid.

The mode 1 is effective, for example, in a case of using a liquid ejection head of a thermal type that employs an electrothermal converter (a heater) as the pressure generation element 12, or in other words, in a case of using a liquid ejection head that utilizes a bubbling phenomenon that depends heavily on properties of a liquid. This liquid ejection head is prone to destabilize bubbling of the liquid due to a scorched portion of the liquid developed on a surface of the heater. The liquid ejection head also has a difficulty in ejecting some types of liquids such as non-aqueous inks. However, if a bubbling liquid that is suitable for bubble generation and is less likely to develop scorch on the surface of the heater is used as the first liquid and a functional liquid having a variety of functions is used as the second liquid by adopting the mode 1, it is possible to eject the liquid such as a non-aqueous ink while suppressing the development of the scorch on the surface of the heater.

The mode 2 is effective for ejecting a liquid such as a high solid content ink not only in the case of using the liquid ejection head of the thermal type but also in a case of using a liquid ejection head that employs a piezoelectric element as the pressure generation element 12. To be more precise, the mode 2 is effective in the case of ejecting a high-density pigment ink having a large content of a pigment being a coloring material onto a printing medium. In general, by increasing the density of the pigment in the pigment ink, it is possible to improve chromogenic properties of an image printed on a printing medium such as plain paper by using the high-density pigment ink. Moreover, by adding a resin emulsion (resin EM) to the high-density pigment ink, it is possible to improve abrasion resistance and the like of a printed image owing to the resin EM formed into a film. However, an increase in solid component such as the pigment and the resin EM tends to develop agglomeration at a close interparticle distance, thus causing deterioration in dispersibility. The pigment is especially harder to disperse than the resin EM. For this reason, the pigment and the resin EM are dispersed by reducing the amount of one of them, or more specifically, by setting an amount ratio of the pigment to the resin EM to about 4/15 wt % or 8/4 wt %. On the other hand, by using a high-density resin EM ink as the first liquid and using the high-density pigment ink as the second ink while adopting the mode 2, it is possible to eject the high-density resin EM ink and the high-density pigment ink at a predetermined proportion. As a consequence, it is possible to print an image by depositing the high-density pigment ink and the high-density resin EM ink on the printing medium (the amount ratio of the pigment to the resin EM at about 8/15 wt %), thereby printing a high-quality image that can be hardly achievable with a single ink, or in other words, an image with excellent abrasion resistance and the like.

(Separation and Collection of Liquids)

Next, a description will be given of collection of the first liquid 31 through the first outflow port 25 and collection of the second liquid 32 through the second outflow port 26.

Figure 14A:
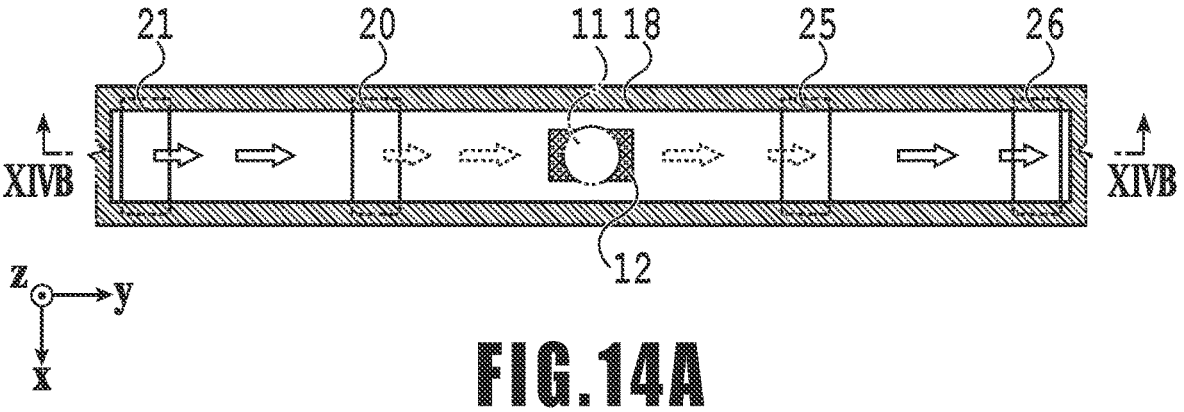
FIG. 14A is a transparent view of a liquid flow passage of a comparative example.
Figure 14B:
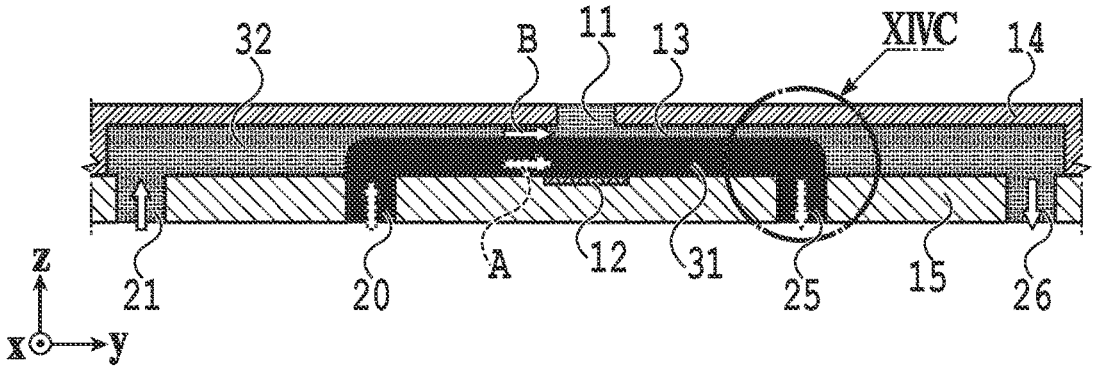
FIG. 14B is a cross-sectional view taken along the XIVB-XIVB line in FIG. 14A.
Figure 14C:
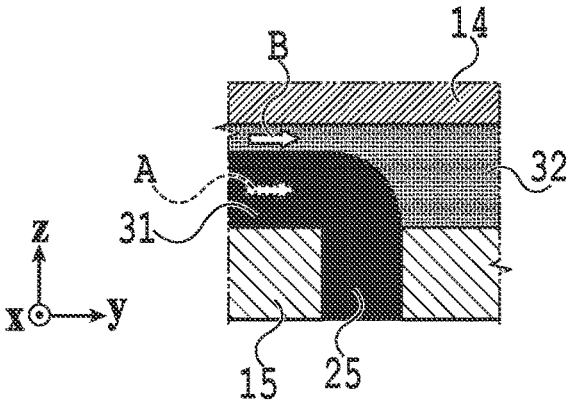
FIG. 14C is an enlarged diagram of a portion XIVC in FIG. 14B.
Figure 15A:
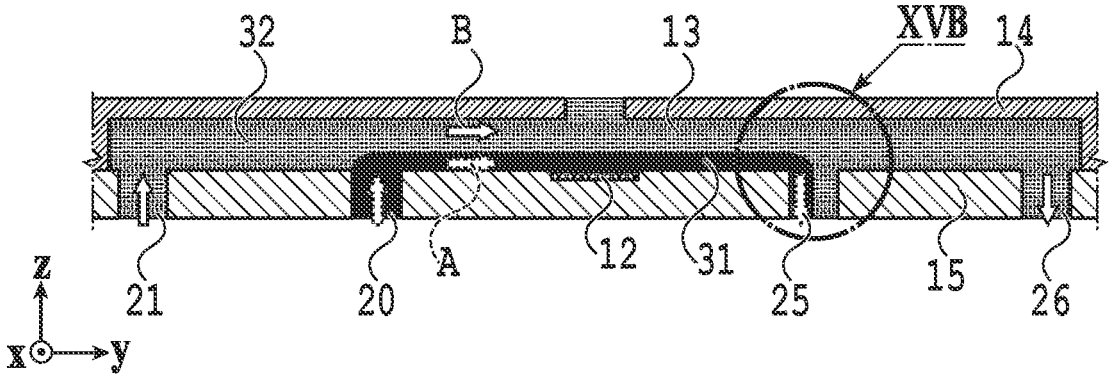
FIG. 15A is a cross-sectional view of the liquid flow passage in FIG. 14A in a state where first and second liquids flow out in a mixed fashion.
Figure 15B:
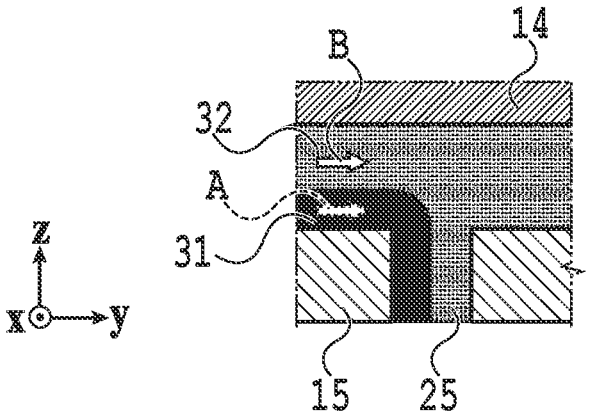
FIG. 15B is an enlarged diagram of a portion XVB in FIG. 15A.

FIGS. 14A to 15B are diagrams for explaining a comparative example of a method of collecting the first liquid 31 and the second liquid 32. FIG. 14A is a transparent view which is viewed from the ejection port 11 side (the +z direction side), FIG. 14B is a cross-sectional view taken along the XIVB-XIVB line in FIG. 14A which represents a case where the water phase thickness $h_1$ of the first liquid 31 is relatively large, and FIG. 14C is an enlarged diagram of a portion XIVC in FIG. 14B. FIG. 15A is a cross-sectional view similar to FIG. 14B but representing a case where the water phase thickness $h_1$ of the first liquid 31 is relatively small, and FIG. 15B is an enlarged diagram of a portion XVB in FIG. 15A.

The water phase thickness ratio $h_r$ is constant in the case where the viscosity ratio $\eta_r$ and the flow rate ratio $Q_r$ are constant. As a consequence, the first liquid 31 flows while retaining the constant water phase thickness $h_1$ as long as the height H of the liquid flow passage (the pressure chamber) 13 remains the same. As for the mode of the first liquid 31 to flow out of the first outflow port 25, there are two modes as follows:

Outflow mode 1: a mode of causing only the first liquid 31 to flow out of the first outflow port 25 (see FIG. 14C); and Outflow mode 2: a mode of causing a mixture of the first liquid 31 and the second liquid 32 to flow out of the first outflow port 25 (see FIG. 15B).

In order to cause only the first liquid 31 to flow out as in the outflow mode 1, it is necessary to set the water phase thickness $h_1$ of the first liquid 31 substantially equal to the width in they direction of the first outflow port 25 as shown in FIG. 14C. However, the water phase thickness $h_1$ of the first liquid 31 needs to be reduced in thickness in the case of the above-mentioned mode 1 of ejecting only the second liquid. If the width in the y direction of the first outflow port 25 is reduced in accordance therewith, a supply performance of the first liquid 31 is deteriorated. It is therefore difficult to set the water phase thickness $h_1$ of the first liquid 31 and the width in they direction of the first outflow port 25 to the same level. As a consequence, the water phase thickness $h_1$ of the first liquid 31 and the width in the y direction of the first outflow port 25 vary from each other as shown in FIG. 15B, whereby the first liquid 31 and the second liquid 32 are mixed together and flow out of the first outflow port 25 as in the outflow mode 2. In other words, separation and collection of the first liquid 31 and the second liquid 32 are not achieved successfully.

Given the situation, in this embodiment, a separation wall 41 is provided on a surface 15A of the silicon substrate 15 defining a bottom surface (an inner surface) of the liquid flow passage 13 and at a position downstream of the first outflow port 25 in a direction (y direction) of flow of the liquid as shown in FIGS. 4B and 5C. Specifically, the separation wall 41 is located on a section of the substrate in the liquid flow passage, which is on the side opposite to the pressure chamber across the first outflow port 25. The separation wall 41 is a wall having a portion located higher than the surface 15A of a section of the silicon substrate 15 upstream of the first outflow port 25 in the direction of flow of the liquid (the y direction). In other words, the separation wall 41 includes a portion located higher than a surface of a section of the substrate where the pressure chamber is provided on a side opposite to the wall 41 across the first outflow port 25. The expression "having a portion located higher" means that the whole separation wall 41 does not always have to be located higher than the surface 15A of the section of the silicon substrate 15 upstream of the first outflow port 25 in the direction of flow of the liquid. As described earlier, the first liquid 31 and the second liquid 32 flow in the liquid flow passage 13 and the pressure chamber 18 in contact with each other such that the second liquid 32 is stacked on the first liquid 31. The interface at which the first liquid 31 is in contact with the second liquid 32 extends in a horizontal direction. The separation wall 41 is a wall for guiding the first liquid 31 to the first outflow port 25, and is provided on the surface 15A of the silicon substrate 15 at a surrounding portion of the first outflow port 25 on a downstream side in the direction of flow of the liquid (the y direction) as described above. In this example, the separation wall 41 is provided to project from the surface 15A such that its end portion on the upstream side in the direction of flow of the liquid is located above an open end on the downstream side of the first outflow port 25. In the meantime, the separation wall 41 is provided in such a way as to extend between the first outflow port 25 and the second outflow port 26. An upper surface of the separation wall 41 is located higher by a distance Z in FIG. 5C than the surface (the inner surface of the liquid flow passage 13) 15A of the silicon substrate 15 on the upstream side. By providing the separation wall 41 as described above, the first liquid 31 tends to run into the separation wall 41 so as to be guided to the first outflow port 25. On the other hand, the second liquid 32 does not run into the separation wall 41 but instead tends to flow to the downstream side in the direction of flow of the liquid so as to be guided to the second outflow port 26. In this way, the first liquid 31 and the second liquid 32 can be appropriately separated and efficiently collected. This also applies to the case where the water phase thickness $h_1$ of the first liquid 31 is small. Meanwhile, the separation wall 41 is located at a position away from the ejection port (on a side opposite to the ejection port across the first outflow port) instead of being located in the vicinity of the ejection port where the interface is prone to be most turbulent due to the ejection operation. For this reason, the first liquid can be guided to the first outflow port without being disturbed very much by the turbulence in the vicinity of the ejection port, because the turbulence on the interface becomes smaller as the interface recedes from the vicinity of the ejection port where the turbulence is largest.

As shown in FIG. 4A, a width in the x direction of the first outflow port 25 is larger than a width in the x direction of the liquid flow passage 13 in this example. However, the width of the first outflow port 25 may be equal to the width of the liquid flow passage 13 or smaller than the width of the liquid flow passage 13. In those cases, the first liquid 31 and the second liquid 32 can also be efficiently separated and collected. From the viewpoint of efficiency of the separation and collection, it is preferable to set the width of the first outflow port 25 larger than the width of the liquid flow passage 13 as shown in this example.

Figure 7A:
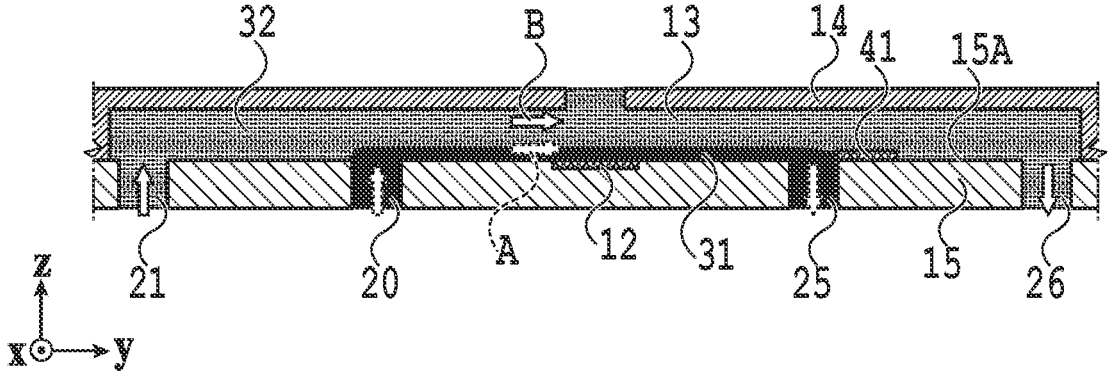
FIG. 7A is a cross-sectional view of a liquid flow passage including another example of a first outflow port of the first embodiment.
Figure 7B:
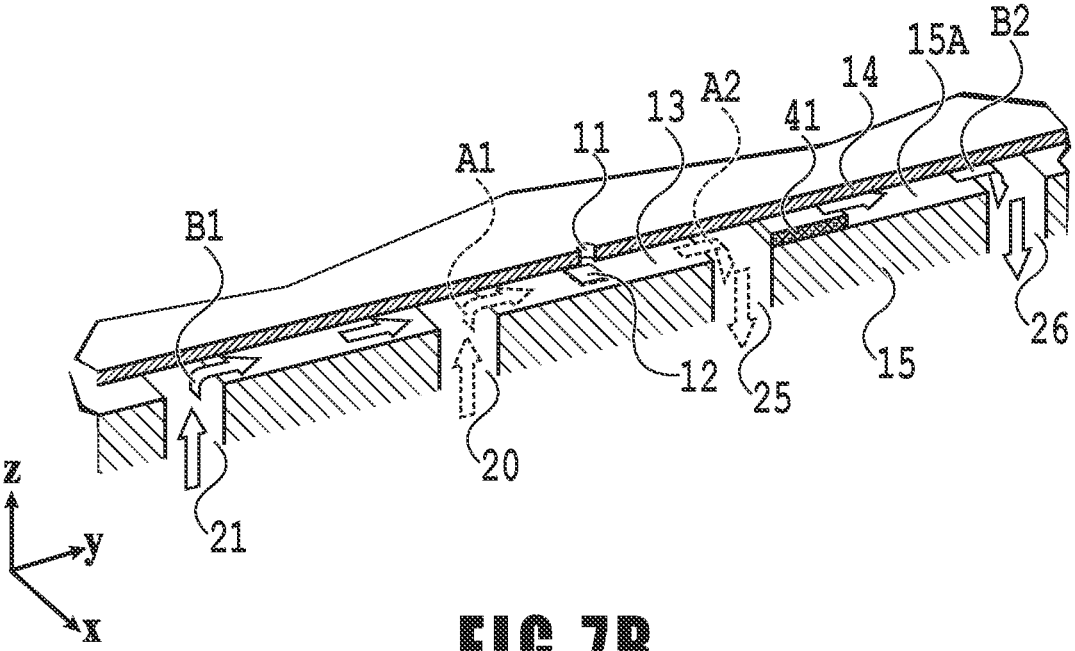
FIG. 7B is a perspective view of the liquid flow passage in FIG. 7A.

Incidentally, the separation wall 41 does not always have to be provided in such a way as to extend across the entire region between the first outflow port 25 and the second outflow port 26, but may be provided at part of that region as shown in FIGS. 7A and 7B. This configuration also makes it possible to efficiently separate and collect the first liquid 31 and the second liquid 32. Nevertheless, in order to improve efficiency of the separation and collection of the first liquid 31 and the second liquid 32, it is preferable to provide the separation wall 41 at least at a position in the vicinity of the surrounding portion of the first outflow port 25 on the downstream side in the direction of flow of the liquid (the y direction) as shown in FIGS. 7A and 7B. The separation wall 41 may be formed from part of the silicon substrate 15 (such as silicon constituting the silicon substrate or a film on the silicon substrate) or may be formed from a member different from the silicon substrate 15 (such as a resin layer and a metal layer).

Figure 8A:
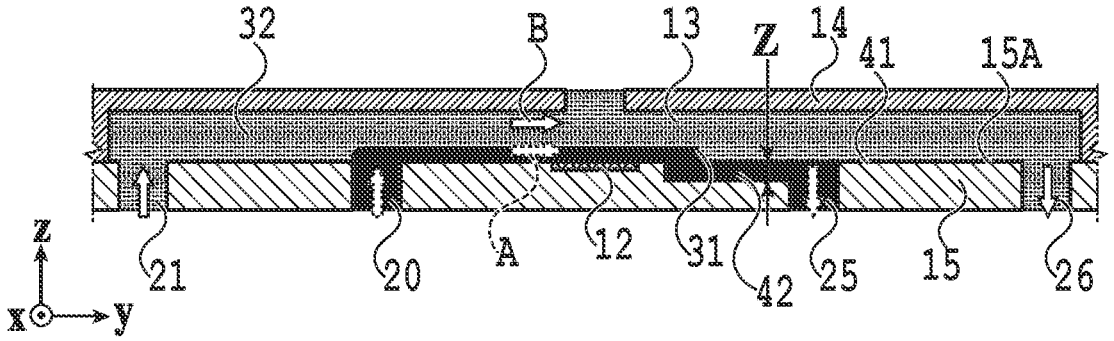
FIG. 8A is a cross-sectional view of a liquid flow passage including still another example of the first outflow port of the first embodiment.
Figure 8B:
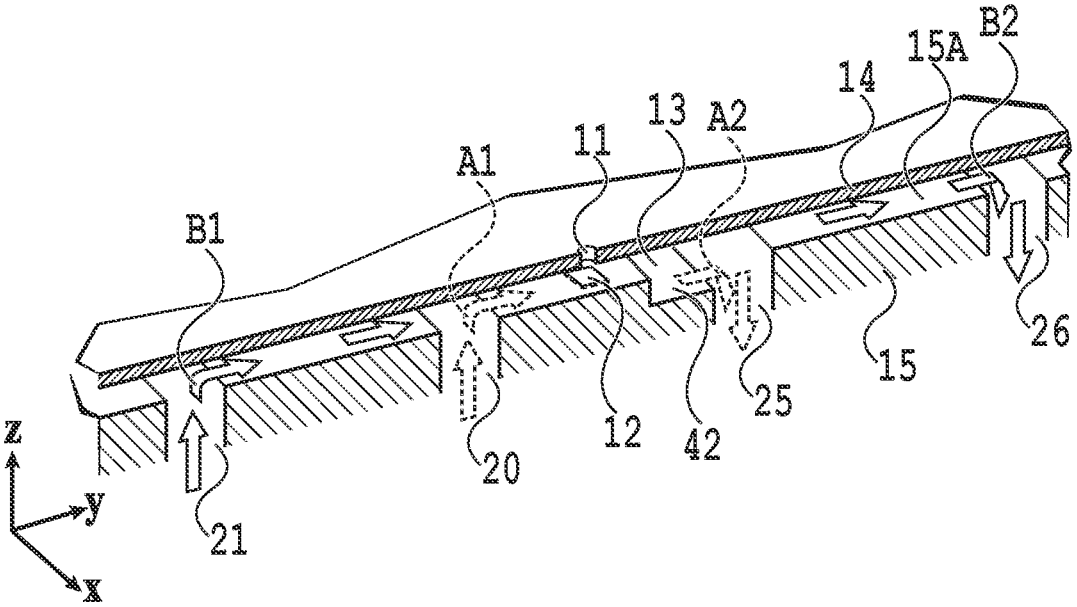
FIG. 8B is a perspective view of the liquid flow passage in FIG. 8A.

Next, an example of providing a dent portion will be described as another example of provision of the separation wall. The silicon substrate 15 shown in FIGS. 8A and 8B includes a dent portion 42 formed in the surface 15A on the upstream side of the first outflow port 25 in the direction of flow of the liquid. Specifically, the dent portion 42 is located at the surrounding portion of the first outflow port 25 on the upstream side in the direction of flow of the liquid (the y direction). The dent portion 42 is set to a position located lower by a distance Z in FIG. 8A than the surface 15A of the silicon substrate 15. The surface 15A of the silicon substrate 15 on the downstream side of the first outflow port 25 in the direction of flow of the liquid is not provided with any dent portion. In this way, a portion (such as a side wall of the silicon substrate 15 on the downstream side of the first outflow port 25) located higher than the surface 15A of the silicon substrate 15 on the upstream side of the first outflow port 25 in the direction of flow of the liquid is defined on the downstream side of the first outflow port 25 in the direction of flow of the liquid. That is to say, of the surrounding portion of the first outflow port 25, a section on the downstream side in the y direction is relatively higher by the distance Z than a section on the upstream side in the y direction, whereby the section on the downstream side serves as the separation wall 41. In other words, this is equivalent to the presence of the separation wall 41 on the substrate on the side opposite to the pressure chamber across the first outflow port. This separation wall 41 is located higher than the surface of the substrate on the side opposite to the separation wall 41 across the first outflow port. This configuration can also efficiently separate and collect the first liquid 31 and the second liquid 32. Note that the dent portion 42 can be formed by subjecting an oxide film on the silicon substrate 15 to an etching treatment or subjecting the silicon substrate 15 to dry etching, for example. The dent portion 42 may be used together with the separation wall 41 described with reference to FIGS. 4A to 5C.

The first liquid 31 and the second liquid 32 thus separated and collected are preferably put back into the pressure chamber again for reuse. In other words, it is preferable to circulate the first liquid 31 and the second liquid 32 that flow in the pressure chamber between the pressure chamber and an outside unit.

Second Embodiment

Figure 9A:
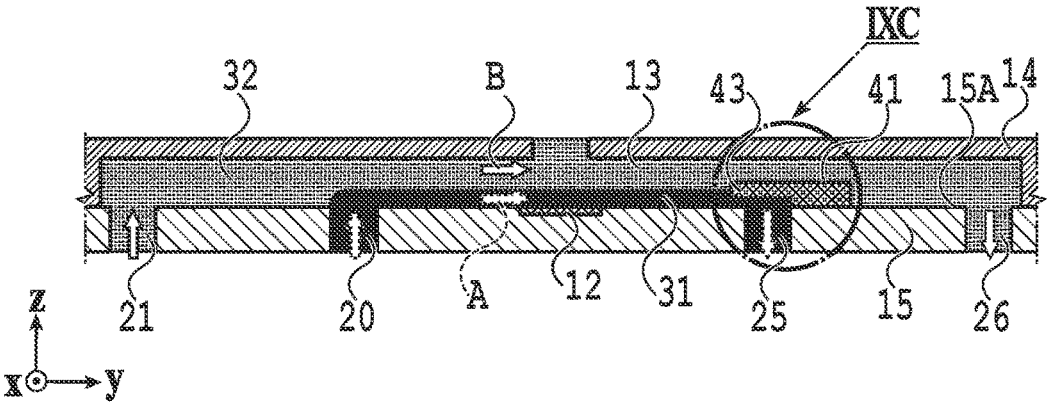
FIG. 9A is a cross-sectional view of a liquid flow passage according to a second embodiment.
Figure 9B:
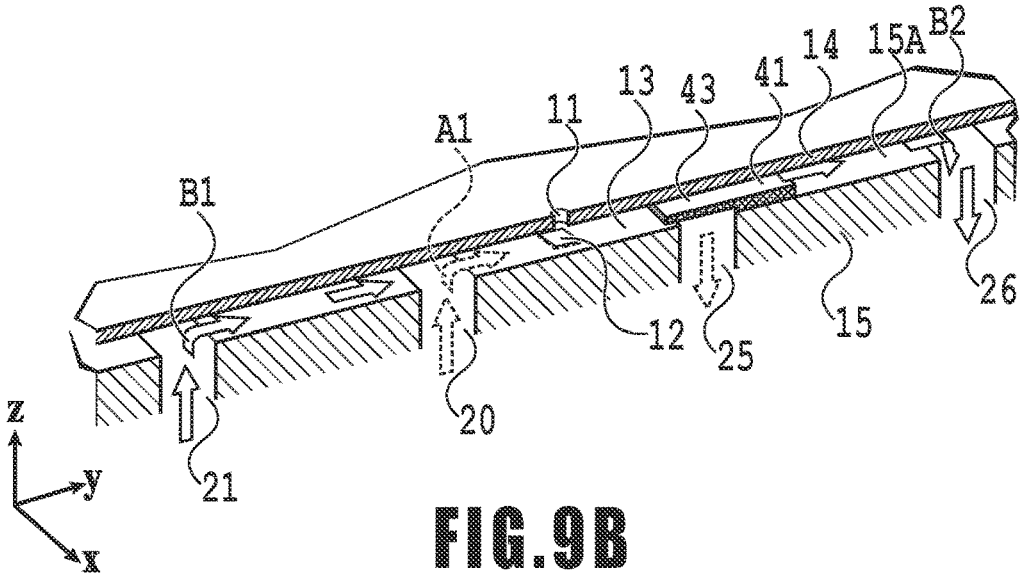
FIG. 9B is a perspective view of the liquid flow passage in FIG. 9A.

FIGS. 9A to 10B are explanatory diagram of a second embodiment. FIG. 9A is a cross-sectional view of the liquid flow passage 13, FIG. 9B is a perspective view of the liquid flow passage 13, and FIG. 9C is an enlarged diagram of a portion IXC in FIG. 9A. The only difference of FIGS. 9A and 9B from FIGS. 10A and 10B lies in the water phase thickness $h_1$ of the first liquid 31.

(Relation Between Water Phase Thickness and Separation Wall)

As shown in FIGS. 9A to 10B, the separation wall 41 of this embodiment is provided with a projection 43 that projects to the upstream side in the direction of flow of the liquid (the y direction).

Figure 9C:
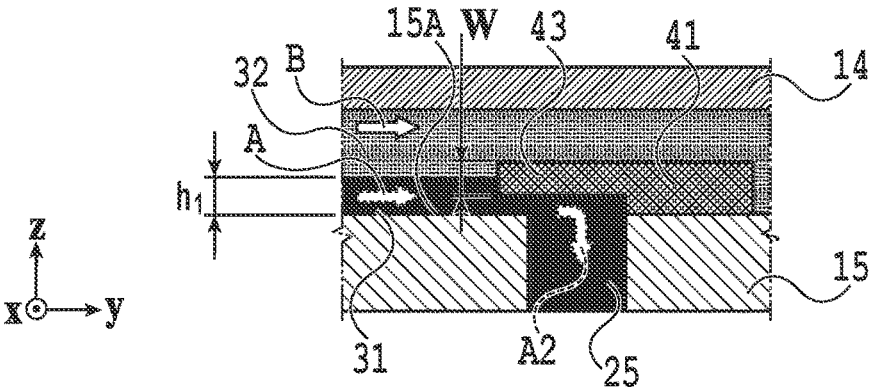
FIG. 9C is an enlarged diagram of a portion IXC in FIG. 9A.
Figure 10A:
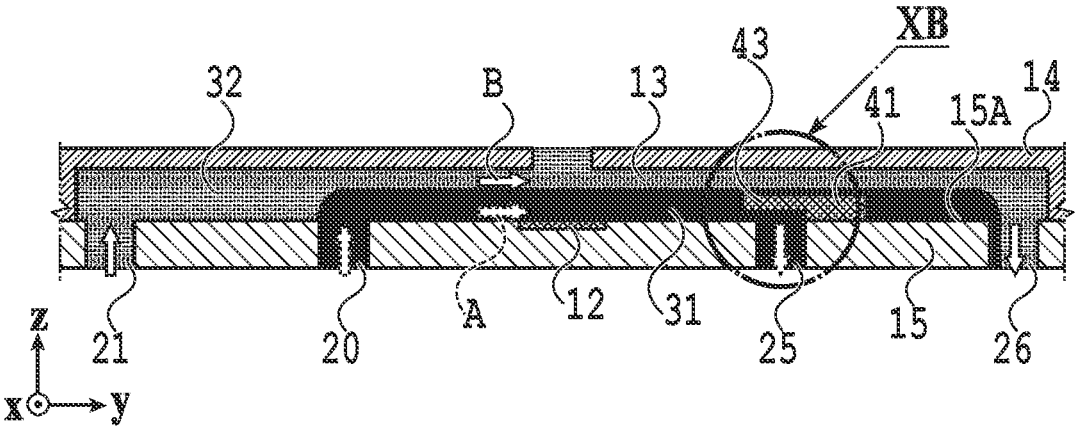
FIG. 10A is a cross-sectional view of the liquid flow passage in FIG. 9A in a state where first and second liquids do not collide with a projection.
Figure 10B:
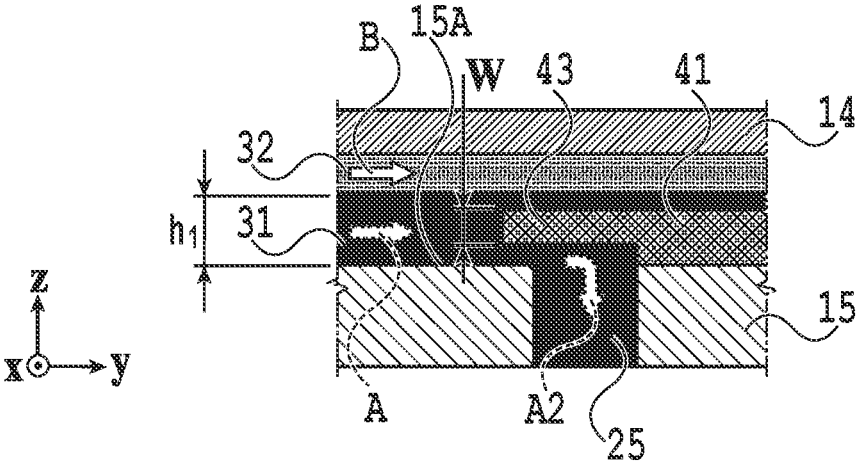
FIG. 10B is an enlarged diagram of a portion XB in FIG. 10A.

The projection 43 projects from the separation wall 41 to the upstream side in the direction of flow of the liquid (they direction). For this reason, the interface (the liquid-liquid interface) between the first liquid 31 and the second liquid 32 collides with the projection 43 before the first liquid 31 flows out of the first outflow port 25. The interface collides with the projection 43 while stably retaining its position. Accordingly, efficiency of the separation and collection of the first liquid 31 and the second liquid 32 is improved. Specifically, by causing the interface to collide with the projection 43 as shown in FIG. 9C, the first liquid 31 is more likely to flow selectively out of the first outflow port 25 and the second liquid 32 is more likely to flow selectively out of the second outflow port 26. On the other hand, if the interface passes above the projection 43 without colliding with the projection 43 as shown in FIG. 10B, a mixture of the first liquid 31 and the second liquid 32 flows out of the second outflow port 26. Though the first liquid 31 and the second liquid 32 can be separated and collected even in the example shown in FIGS. 10A and 10B thanks to the provision of the separation wall 41, it is preferable to locate the projection 43 of the separation wall 41 at the position where the collision of the interface between the first liquid 31 and the second liquid 32 takes place. The same applies to the case of not providing the projection 43. Hence, it is preferable to locate the separation wall 41 at the position where the collision of the interface between the first liquid 31 and the second liquid 32 takes place.

Moreover, in order to ensure robustness of the separation and collection of the first and second liquids in case of a fluctuation of the position of the interface, it is preferable to control the position of the interface at such a position that the interface collides with a central part in a direction of a thickness W of the projection 43. As described previously, the position of the interface corresponds to the water phase thickness ratio $h_r$ relative to the viscosity ratio $\eta_r$ and the flow rate ratio $Q_r$. However, the viscosity ratio $\eta_r$ varies with long-term use of the first liquid 31 and the second liquid 32 while the flow rate ratio $Q_r$ varies with flow rate pulsations due to the pumps for feeding the first liquid 31 and the second liquid 32. Accordingly, it is important to ensure robustness of the separation and collection of the first liquid 31 and the second liquid 32 relative to the change in position of the interface.

Figure 11A:
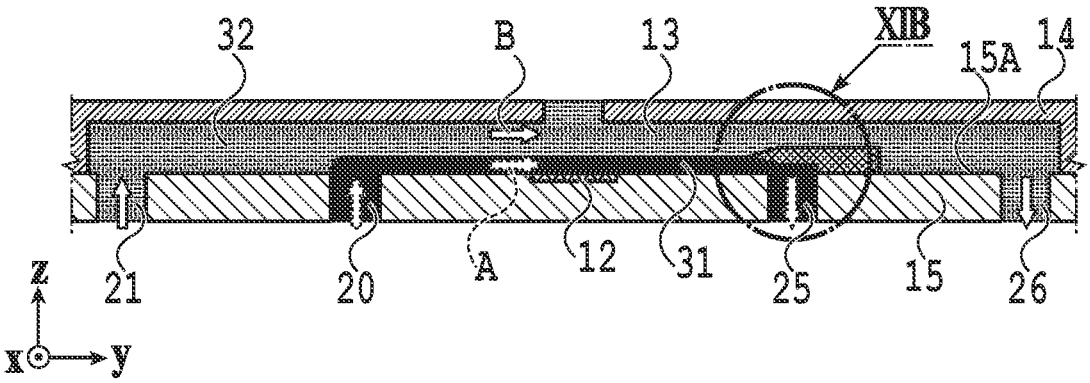
FIG. 11A is a cross-sectional view of a liquid flow passage including still another example of the first outflow port of the second embodiment.
Figure 11B:
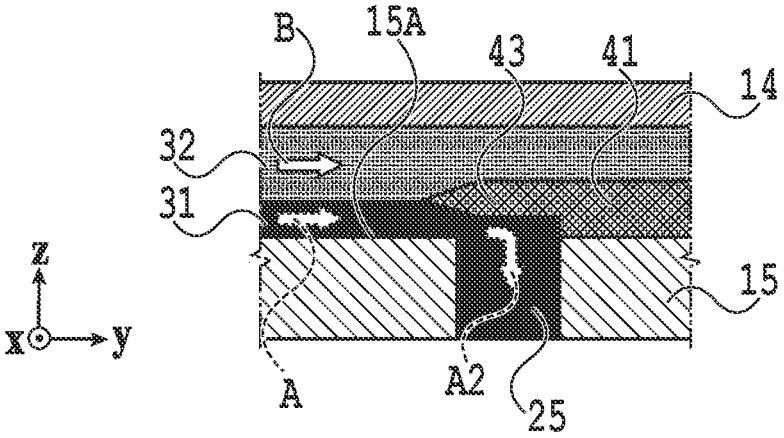
FIG. 11B is an enlarged diagram of a portion XIB in FIG. 11A.

In order to ensure the robustness, it is effective to increase the thickness W of the projection 43. However, the increase in thickness W brings about reduction in height of a portion of the liquid flow passage 13 for the flow of the second liquid 32 before flowing out of the second outflow port 26, thereby causing deterioration in supply performance of the second liquid 32. The thickness W therefore needs to be set to an appropriate length from this point of view. In the meantime, the shape of the projection 43 may be formed into such a shape provided with an acute-angled tip as shown in FIGS. 11A and 11B.

(Relation Between Water Phase Thickness and Projecting Amount of Projection)

Figure 12A:
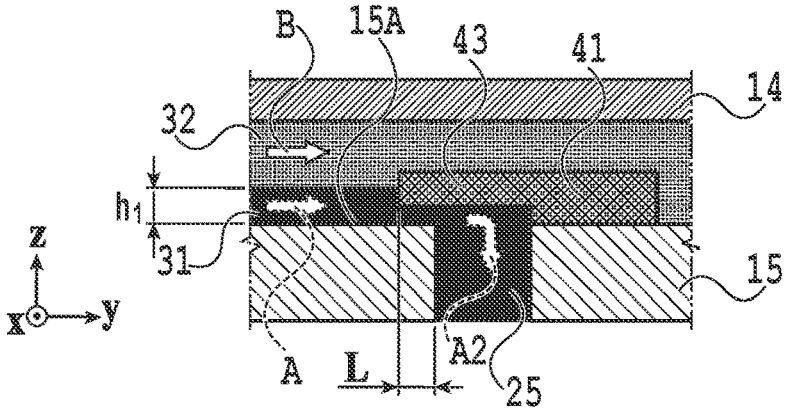
FIGS. 12A, 12B, and 12C are explanatory diagrams of various other examples of the first outflow port of the second embodiment, respectively.
Figure 12B:
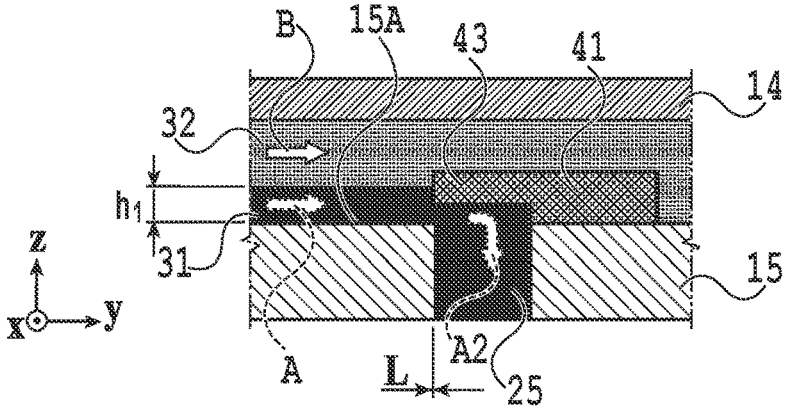
Figure 12C:
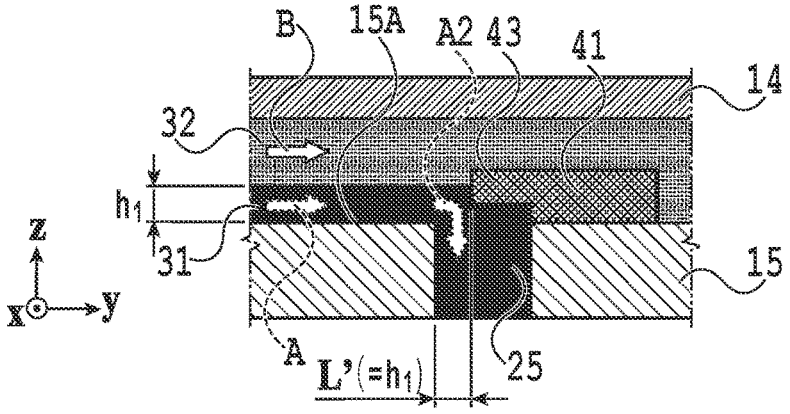

FIGS. 12A, 12B, and 12C are explanatory diagrams showing cases of various projecting amounts (lengths of projection from a portion above the first outflow port 25 to the upstream side in the y direction) L of the projection 43 of the separation wall 41. In each of the cases of the FIGS. 12A, 12B, and 12C with the various projecting amounts L, the interface between the first and second liquids collides with the projection 43 as with the case shown in FIG. 9C. The projection 43 in FIG. 12A projects by a projecting amount L from a position to entirely cover the portion above the first outflow port 25 further to the upstream side in they direction. The projecting amount L of the projection 43 in FIG. 12B is zero and the projection 43 is located at the position to just entirely cover the portion above the first outflow port 25. The projection 43 in FIG. 12C does not entirely cover the portion above the first outflow port 25, but is located at a position receding by an amount L' corresponding to the water phase thickness $h_1$ of the first liquid 31 from the end portion of the first outflow port 25 on the upstream side in the direction of flow of the liquid.

In the cases of FIGS. 12A and 12B, the interface collides with the projection 43 while stably retaining its position. Accordingly, efficiency of the separation and collection of the first and second liquids is improved. On the other hand, the projection 43 that entirely covers the portion above the first outflow port 25 brings about the reduction in height of the portion of the liquid flow passage 13 for the flow of the second liquid 32 before flowing out of the second outflow port 26, thereby causing the deterioration in supply performance of the second liquid 32. Therefore, the smaller projecting amount L of the projection 43 is preferred from the viewpoint of the supply performance of the second liquid 32. In order to achieve both efficiency of the separation and collection of the first liquid 31 as well as the second liquid 32 and the supply performance of the second liquid 32, it is preferable to take into account the water phase thickness $h_1$ of the first liquid 31 for determining the position of the projection 43. Specifically, as shown in FIG. 12C, the position of the projection 43 may recede by the amount L' from the end portion of the first outflow port 25 on the upstream side in the direction of flow of the liquid so as to satisfy $L' \geq h_1$ preferably or to satisfy $L' = h_1$ more preferably.

Third Embodiment

This embodiment also uses the liquid ejection head 1 and the liquid ejection apparatus shown in FIGS. 1 to 3.

FIGS. 13A to 13D are diagrams showing a configuration of the liquid flow passage 13 of this embodiment. The liquid flow passage 13 of this embodiment is different from the liquid flow passage 13 described in the first embodiment in that a third liquid 33 is allowed to flow in the liquid flow passage 13 in addition to the first liquid 31 and the second liquid 32. By allowing the third liquid 33 to flow in the pressure chamber, it is possible to use the bubbling medium with the high critical pressure as the first liquid while using any of the inks of different colors, the high-density resin EM, and the like as the second liquid and the third liquid.

In the liquid flow passage 13 of this embodiment, the first, second, and third liquids 31, 32, and 33 can flow such that the third liquid 33 can also form a parallel flow in state of laminar flow in addition to the parallel flows in the state of laminar flow by the first liquid 31 and the second liquid 32 in the above-described first embodiment as shown in FIGS. 13A to 13D. In the surface 15A of the silicon substrate 15 corresponding to the inner surface (bottom portion) of the liquid flow passage 13, the second inflow port 21, a third inflow port 22, the first inflow port 20, the first outflow port 25, a third outflow port 27, and the second outflow port 26 are formed in this order in the y direction. The pressure chamber 18 including the ejection port 11 and the pressure generation element 12 is located substantially at the center between the first inflow port 20 and the first outflow port 25 in the liquid flow passage 13.

As with the above-described embodiment, the first liquid 31 and the second liquid 32 flow from the first and second inflow ports 20 and 21 into the liquid flow passage 13, then flow in the y direction through the pressure chamber 18, and then flow out of the first and second outflow ports 25 and 26. The third liquid 33 flowing through the third inflow port 22 is introduced into the liquid flow passage 13 as indicated by an arrow C1, and then flows in a direction of an arrow C in the liquid flow passage 13. Thereafter, the third liquid 33 passes the pressure chamber 18, is discharged from the third outflow port 27 as indicated by an arrow C2, and then is collected. As a consequence, the first liquid 31, the second liquid 32, and the third liquid 33 flow together in the y direction between the first inflow port 20 and the first outflow port 25 in the liquid flow passage 13. In this instance, in the pressure chamber 18, the first liquid 31 is in contact with the inner surface of the pressure chamber 18 (the surface 15A of the silicon substrate 15) where the pressure generation element 12 is located. Meanwhile, the second liquid 32 forms the meniscus at the ejection port 11 and the third liquid 33 flows between the first liquid 31 and the second liquid 32.

In this embodiment as well, a separation wall 41A is provided on the substrate 15 in such a way as to be located on the downstream side in the direction of flow of the liquid (the y direction) at the surrounding portion of the first outflow port 25 as with the above-described first embodiment. Moreover, a separation wall 41B is provided on the substrate 15 in such a way as to be located on a downstream side in the y direction at a surrounding portion of the third outflow port 27. These separation walls 41A and 41B have similar functions to that of the above-described separation wall 41 of the first embodiment. Specifically, the separation wall 41A efficiently separates the first liquid 31 from the third liquid 33 while the separation wall 41B efficiently separates the third liquid 33 from the second liquid 32. Here, at least one of the separation walls 41A and 41B needs to be provided. In the meantime, any of these separation walls 41A and 41B may be provided with a projection similar to the one described in conjunction with the second embodiment. Furthermore, a configuration similar to this embodiment should also apply to a case where four or more types of liquids flow in a stacked manner in the liquid flow passage 13.

Figure 13A:
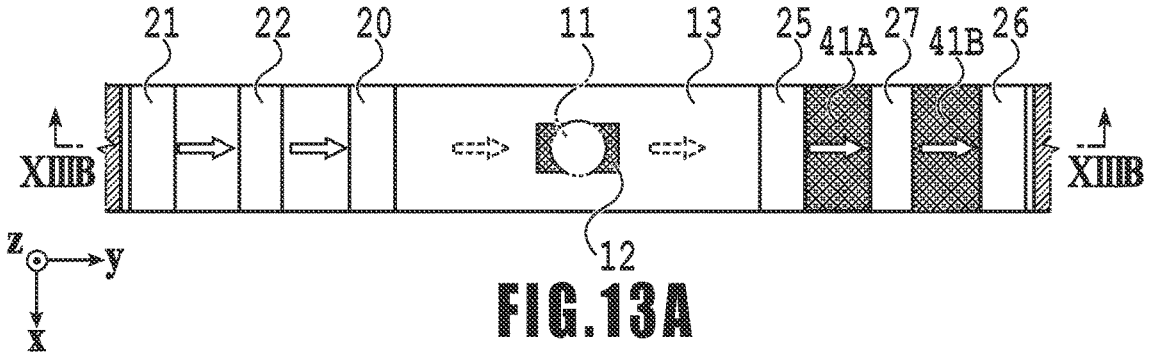
FIG. 13A is a transparent view of a liquid flow passage according to a third embodiment.
Figure 13B:
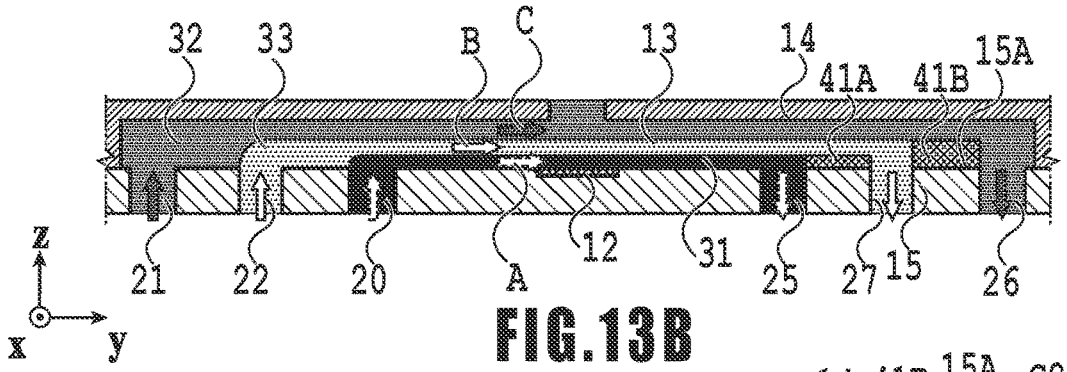
FIG. 13B is a cross-sectional view taken along the XIIIB-XIIIB line in FIG. 13A.
Figure 13C:
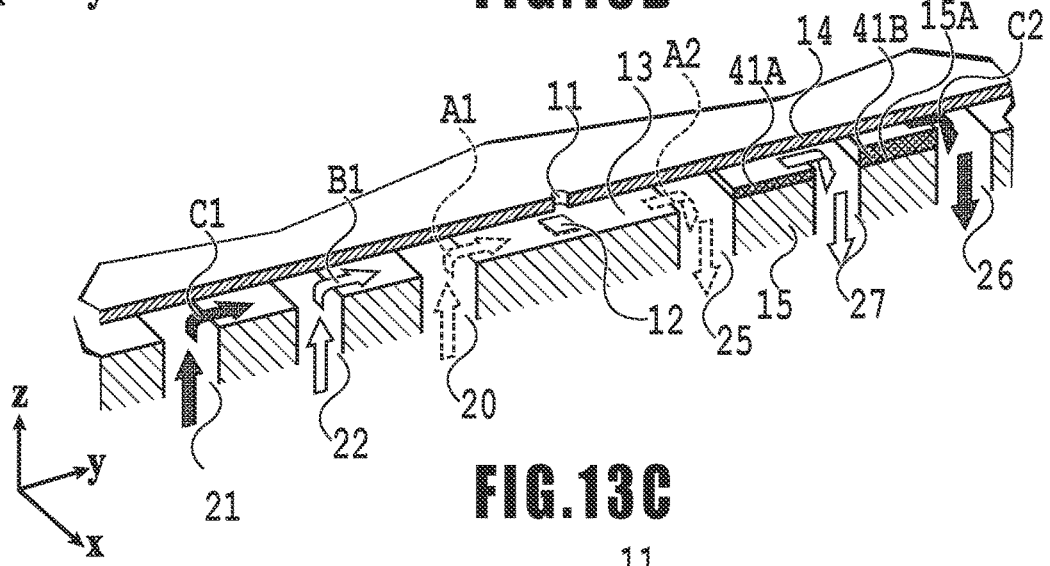
FIG. 13C is a perspective view of the liquid flow passage in FIG. 13A.
Figure 13D:
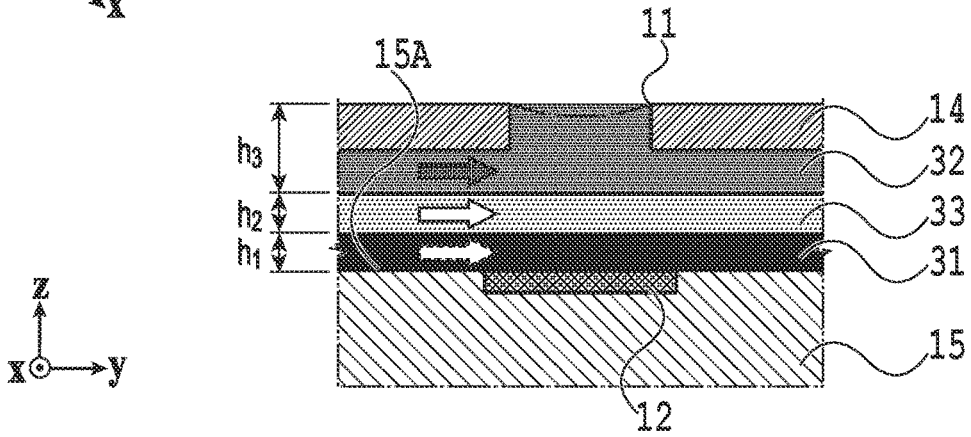
FIG. 13D is an enlarged diagram of a portion of an ejection port in FIG. 13B.

In this embodiment, the CPU 500 controls the flow rate $Q_1$ of the first liquid 31, the flow rate $Q_2$ of the second liquid 32, and a flow rate $Q_3$ of the third liquid 33 by using the liquid circulation unit 504, and causes the three liquids to form three-layered parallel flows steadily as shown in FIG. 13D. Then, in the state where the three-layered parallel flows are formed as described above, the CPU 500 drives the pressure generation element 12 of the liquid ejection head 1 and ejects the droplet from the ejection port 11. Even if the position of each interface is disturbed along with the ejection operation described above, the three-layered parallel flows of the three liquids are recovered in a short time so that the next ejection operation can be started right away. As a consequence, it is possible to execute the good ejection operation of the droplet containing the first, second, and third liquids at the predetermined ratio and to obtain a fine output product with their droplets deposited.

Other Embodiments

The first liquid and the second liquid flowing in the pressure chamber may be circulated between the pressure chamber and an outside unit. If the circulation is not conducted, a large amount of any of the first liquid and the second liquid having formed the parallel flows in the liquid flow passage and the pressure chamber but having not been ejected would remain inside. Accordingly, the circulation of the first liquid and the second liquid with the outside unit makes it possible to use the liquids that have not been ejected in order to form the parallel flows again.

The liquid ejection head and the liquid ejection apparatus in the embodiments are not limited only to the inkjet printing head and the inkjet printing apparatus configured to eject an ink. The liquid ejection head and the liquid ejection apparatus in the embodiments are applicable to various apparatuses including a printer, a copier, a facsimile machine equipped with a telecommunication system, and a word processor including a printer unit, and to other industrial printing apparatuses that are integrally combined with various processing apparatuses. In particular, since various liquids can be used as the second liquid, the liquid ejection head and the liquid ejection apparatus are also adaptable to other applications including biochip fabrication, electronic circuit printing, and so forth.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-143907, filed Jul. 31, 2018, and No. 2019-079682, filed Apr. 18, 2019, which are hereby incorporated by reference herein in their entirety.

What is claimed is:

1. A liquid ejection head comprising:

a substrate;

a liquid flow passage formed on the substrate and configured to allow a first liquid and a second liquid to flow inside, the liquid flow passage including a pressure chamber;

a pressure generation element configured to apply pressure to the first liquid in the pressure chamber; and an ejection port configured to eject the second liquid, wherein in a case where a direction of ejection of the second liquid is a direction from below to above, the second liquid flows above the first liquid in the pressure chamber, the substrate includes an outflow port located downstream of the pressure chamber in a direction of flow of the first liquid and configured to allow the first liquid to flow out of the liquid flow passage, an interface at which the first liquid and the second liquid are in contact with each other is located above the pressure generation element, and the liquid ejection head includes a wall for separating the first liquid and the second liquid located in the liquid flow passage and on a section of the substrate on a side opposite to the pressure chamber across the outflow port, the wall including a portion located higher than a surface of a section of the substrate where the pressure chamber is located on a side opposite to the wall across the outflow port.

2. The liquid ejection head according to claim 1, wherein the first liquid and the second liquid form laminar flows in the pressure chamber.

3. The liquid ejection head according to claim 1, wherein the first liquid and the second liquid form parallel flows in the pressure chamber.

4. The liquid ejection head according to claim 2, wherein the first liquid and the second liquid form parallel flows in the pressure chamber.

5. The liquid ejection head according to claim 1, wherein the wall is provided at a position where the interface at which the first liquid and the second liquid are in contact with each other collides with the wall.

6. The liquid ejection head according to claim 3, wherein the wall is provided at a position where the interface at which the first liquid and the second liquid are in contact with each other collides with the wall.

7. The liquid ejection head according to claim 4, wherein the wall is provided at a position where the interface at which the first liquid and the second liquid are in contact with each other collides with the wall.

8. The liquid ejection head according to claim 1, wherein the wall is a wall projecting from the surface of the substrate.

9. The liquid ejection head according to claim 4, wherein the wall is a wall projecting from the surface of the substrate.

10. The liquid ejection head according to claim 8, wherein the wall includes a projection projecting to an upstream side in the direction of flow of the first liquid so as to be located above at least part of the outflow port.

11. The liquid ejection head according to claim 9, wherein the wall includes a projection projecting to an upstream side in the direction of flow of the first liquid so as to be located above at least part of the outflow port.

12. The liquid ejection head according to claim 10, wherein the projection is provided at a position where the interface at which the first liquid and the second liquid are in contact with each other collides with the projection.

13. The liquid ejection head according to claim 11, wherein the projection is provided at a position where the interface at which the first liquid and the second liquid are in contact with each other collides with the projection.

14. The liquid ejection head according to claim 1, wherein the substrate includes an indented portion provided on an upstream side of the outflow port with respect to the direction of flow of the first liquid, the indented portion being formed by indenting the surface of the substrate.

15. The liquid ejection head according to claim 4, wherein the substrate includes an indented portion provided on an upstream side of the outflow port with respect to the direction of flow of the first liquid, the indented portion being formed by indenting the surface of the substrate.

16. The liquid ejection head according to claim 1, wherein the first liquid flowing in the pressure chamber is circulated between the pressure chamber and an outside unit.

17. The liquid ejection head according to claim 4, wherein the first liquid flowing in the pressure chamber is circulated between the pressure chamber and an outside unit.

18. A liquid ejection module for constituting a liquid ejection head, wherein the liquid ejection head includes:

a substrate, a liquid flow passage formed on the substrate and configured to allow a first liquid and a second liquid to flow inside, the liquid flow passage including a pressure chamber, a pressure generation element configured to apply pressure to the first liquid in the pressure chamber, and an ejection port configured to eject the second liquid, wherein in a case where a direction of ejection of the second liquid is a direction from below to above, the second liquid flows above the first liquid in the pressure chamber, the substrate includes an outflow port located downstream of the pressure chamber in a direction of flow of the first liquid and configured to allow the first liquid to flow out of the liquid flow passage, an interface at which the first liquid and the second liquid are in contact with each other is located above the pressure generation element, the liquid ejection head includes a wall for separating the first liquid and the second liquid located in the liquid flow passage and on a section of the substrate on an opposite side of the pressure chamber across the outflow port, the wall including a portion located higher than a surface of a section of the substrate where the pressure chamber is located across the outflow port, and the liquid ejection head is formed by arraying multiple liquid ejection modules.

19. A liquid ejection apparatus comprising a liquid ejection head:

the liquid ejection head including:

a substrate, a liquid flow passage formed on the substrate and configured to allow a first liquid and a second liquid to flow inside, the liquid flow passage including a pressure chamber, a pressure generation element configured to apply pressure to the first liquid in the pressure chamber, and an ejection port configured to eject the second liquid, wherein in a case where a direction of ejection of the second liquid is a direction from below to above, the second liquid flows above the first liquid in the pressure chamber, the substrate includes an outflow port located downstream of the pressure chamber in a direction of flow of the first liquid and configured to allow the first liquid to flow out of the liquid flow passage, an interface at which the first liquid and the second liquid are in contact with each other is located above the pressure generation element, and the liquid ejection head includes a wall for separating the first liquid and the second liquid located in the liquid flow passage and on a section of the substrate on an opposite side of the pressure chamber across the outflow port, the wall including a portion located higher than a surface of a section of the substrate where the pressure chamber is located across the outflow port.

20. The liquid ejection head according to claim 1, wherein the substrate includes a second outflow port located downstream of the wall in the direction of flow of the second liquid and configured to allow the second liquid to flow out of the liquid flow passage, and the second liquid flows beyond the wall and flows out of the second outflow port.

* * * * *